United States Patent [19]

Woodard

[11] Patent Number: 4,665,655

[45] Date of Patent: May 19, 1987

[54] APPARATUS FOR CLEANING OF ENGINE CYLINDER HEADS, BLOCKS AND OTHER COMPONENTS

[75] Inventor: David A. Woodard, Plain City, Ohio

[73] Assignee: Ampro Equipment, Inc., Plain City, Ohio

[21] Appl. No.: 756,398

[22] Filed: Jul. 17, 1985

[51] Int. Cl.[4] ..... B24C 3/14

[52] U.S. Cl. ..... 51/5 R; 134/76; 134/94; 431/3; 51/419; 51/322

[58] Field of Search ..... 51/5 R, 417, 419, 420, 51/423, 322; 134/19, 20, 76, 94; 431/3

[56] References Cited

U.S. PATENT DOCUMENTS

| | | | |
|---|---|---|---|
| 2,158,063 | 5/1939 | Broadfield | 51/319 |
| 3,429,559 | 2/1969 | Dreher et al. | 134/76 |
| 3,546,816 | 12/1970 | Enegren | 51/423 |
| 4,577,441 | 3/1986 | Brenner | 51/419 |

*Primary Examiner*—Frederick R. Schmidt
*Assistant Examiner*—Robert A. Rose
*Attorney, Agent, or Firm*—Robert E. Stebens

[57] ABSTRACT

Apparatus and method are provided by this invention for cleaning of internal combustion engine components. The method consists of heating the components, removing of dry debris from the components by blasting the component with shot and then physically shaking the component to remove the shot from cavities in the article. The apparatus includes a heating unit for heating of the components to a temperature to burn combustible debris and leaving the components coated only with dry debris and debris removing apparatus operating on the heated components. The debris removing apparatus includes an airless shot blast device for throwing of shot against the article and mechanism for support of the article in the path of the shot and revolution of the article about a horizontal axis. A carrier is provided for a plurality of the components and the carrier is supported for revolution about a horizontal axis during blasting with shot and is revolved and oscillated about transverse axes for removing of shot.

15 Claims, 26 Drawing Figures

APPARATUS FOR CLEANING OF ENGINE CYLINDER HEADS, BLOCKS AND OTHER COMPONENTS

FIELD OF THE INVENTION

This invention relates generally to the cleaning of cylinder heads, blocks and other components for internal combustion engines as a part of a total reconditioning or repair of at least the head components of such engines. This invention relates more specifically to a multi-step system wherein cylinder heads are advantageously processed in sequential steps to effect removal of scale and other materials from surfaces of the cylinder heads.

BACKGROUND OF THE INVENTION

Reconditioning of internal combustion engines, particularly those of an automotive vehicle type, is a significant business founded upon the economic savings achieved through reconditioning of an engine as contrasted to purchase of a complete new engine. Engine reconditioning is labor intensive and thus to be economically feasible, procedures must be employed to minimize labor costs. One aspect of engine reconditioning that has heretofore involved a substantial amount of labor and time and thus accounting for a significant portion of the cost of reconditioning has been the cleaning of the major engine components such as the cylinder heads, blocks, crankshafts, piston rods and oilpans. The cylinder heads, engine blocks and other components of internal combustion engines accumulate not only a heavy external coating of oil and dirt, but the internal surfaces become covered with a scale formed from combustion products in the case of the surfaces associated with the combustion chamber, but other cavities in the head such as those formed for a flow of fluid through the head also become coated with a scale formed from mineral products contained debris materials as a consequence of the elevated temperatures at which internal combustion engines operate, tend to tenaciously adhere to those surfaces and become very difficult to remove. Exterior coatings of oil and dirt can generally be removed to a satisfactory degree through use of cleaning solvents to soften the material and utilization of hand scraping. This is a time consuming process and usually cannot be accomplished to effect the desired degree of cleaning. Similarly, the combustion product scales and the mineral scales that develop on the interior surfaces of the cylinder head can also be removed to an extent by manual means using hammers and chipping tools. However, such techniques are less than desirable not only from the standpoint of general ineffectivity in removing all of the scale, but subject the cylinder head surfaces to mechanical damage from impact with the various types of cleaning tools that are employed.

To enhance cleaning operations, various alternative procedures have been employed not only to enhance the economics through reduction of labor costs, but to improve the effectivity of the cleaning operations. One such procedural technique that has been used is the subjecting of the cylinder head to a heating operation. One of the objectives of the heating operation is to, in effect, burn off the oil or hydrocarbons coating the exterior surfaces. This procedure has been found less effective than desired since the burning procedure results in other combustion products which still combine with other debris that is not combustible and still remains adhered to the exterior surfaces requiring scraping or other removal techniques. A second objective is to attempt loosening of the scales and conditioning them at the elevated temperatures to be more readily removed through employment of scraping and chipping tools. This procedure of heating, but still relying upon the use of manual scraping for removal of the materials, has failed to provide the desired results since considerable labor time is still required and the results are less than desirable since these cylinder heads are of a complex geometrical shape with various configured cavities that are difficult to work with and in many instances are essentially inaccessible through the use of conventional manual tools.

While cleaning of articles that may be caked with oil and dirt coatings or scale formations can be more readily and effectively accomplished by shot blasting operations, the use of shot blast cleaning has not heretofore been deemed suitable for use in connection with cylinder heads because of the difficulty in removing the shot particles from the various internal cavities. This removal of the shot is of particular significance with respect to cylinder heads. The shot, while generally small in size, is fabricated from hardened steel and is highly destructive if retained within the engine cylinders. In shot cleaning techniques, the shot enters the numerous irregularly shaped cavities of the head and may be retained in areas that are not subject to visual inspection. Although the shot may be retained even though various mechanical vibrating and shaking techniques are employed to dislodge the shot, it nevertheless is frequently possible for retained shot to ultimately become dislodged such as during the time that the cylinder head is remounted on an engine block and the shot, even though contained within a coolant cavity, may fall into a cylinder and not be detected. Subsequent operation of the engine will result in effectively destroying the engine through the shot becoming wedged between the circumference of the top of the piston and adjacent cylinder wall and result in scoring of the cylinder wall.

In attempting to more effectively and efficiently remove the shot, techniques such as use of compressed air for blowing out the shot have also been employed, although the results have been less than satisfactory. There have been attempts to devise apparatus to effectively perform this shot removal function by mechanical manipulation of the cylinder heads so as to enable the shot to fall out of the cavities. One such apparatus included several large sized truck tires supported in vertical planes adjacent to each other in axial alignment. The tires are supported on a pair of drive rollers that are rotated and through frictional engagement with the outer face of the tires cause the tires to revolve. A cylinder head or other component that has been shot blasted is placed in the center of the tires with the objective being to roll the cylinder heads about their longitudinal axis to effect removal of the shot. However, this apparatus has not been found satisfactory as it not only fails to effectively manipulate the heads so as to remove all of the shot, but it is inherently limited to processing only one cylinder head at a time thereby failing to achieve a significant monetary saving. As a consequence of the difficulty in removing the shot and inability of these prior techniques to effect removal to a one hundred percent degree, shot cleaning has not been generally accepted or utilized in the cleaning operations for these engine components.

While a heating operation employed in cleaning of cylinder heads assists in the previously employed manual cleaning operations, that heating has not reduced the labor costs to any significant degree. One reason the heating operation, while perhaps enhancing the effectivity of the cleaning, has failed to enable realization of cost reduction is that the cylinder heads, after they are heated to the necessary elevated temperatures of the order of five hundred degrees Fahrenheit must be permitted to cool to a temperature where the workers can again safely handle the heads in performance of the various manual cleaning operations.

SUMMARY OF THE INVENTION

Apparatus and method are provided for the more efficient cleaning of internal combustion engine components such as cylinder heads, blocks, piston rods, crankshafts, oil pans, cover plates and obtain a high degree of effectivity in the removal of the various types of debris. While cylinder heads are specifically mentioned, it will be understood that other engine components are intended to be included. This apparatus and method of the invention in a basic form includes processing apparatus including a heating unit and an airless shot blast unit and a mechanical handling apparatus that enables movement of the cylinder heads from the heating unit to the shot blast unit without requiring any cool down time as would be required with manual handling operations. With this basic form of the apparatus of this invention, the cylinder heads or other components to be reconditioned are first placed in the heating unit and an open flame heating device using a suitable fuel gas heats the heads as well as applying a direct flame to the materials coating the various surfaces of the head. When the heads have been heated to the desired temperature such as of the order of five hundred degrees Fahrenheit, the mechanical handling apparatus is then employed to remove the heads at this elevated temperature and place them in the shot blast unit. It will be noted that the description of the invention is referenced to both singular and plural as to the cylinder heads being processed at any one time. The mechanical handling apparatus that is provided by this invention is of a construction such that the handling of the plurality of the cylinder heads can be readily accomplished and this enables the invention to also effect a significant reduction in processing time. This reduction in processing time due to multiple handling capability is in addition to the elimination of any requirement for effecting cooling of the heads before transport or movement from one unit to the other for further processing.

The airless shot blast unit of the basic apparatus is of a construction that effects a multi-directional application of the shot to the cylinder heads while concurrently revolving the heads in the stream of shot so as to cause the shot to strike against all surfaces of the cylinder heads.

Upon termination of the shot cleaning operation, the cylinder heads are subjected to what can be best described as a physical shaking operation as well as in some instances to mechanical vibration and shock to effect removal of the shot from the heads. In the one form of the invention, the structure of the shot cleaning unit supports the cylinder heads for revolution within a cage-like carrier to revolve the cylinder heads about a generally horizontal axes, thereby in effect shaking the heads to dislodge and remove the shot through the repetitive inverting of the heads. In the case of the smaller sized heads, or other components, the heads may not be rigidly secured in fixed relationship to the carrier so as to enable the heads to move and engage retaining components of the carrier during the course of a revolution of the carrier resulting in vibration and mechanical shock forces being imparted to the heads to effect dislodgment of the shot. This mechanical shot removing procedure is continued for a predetermined time after termination of the shot cleaning procedure.

In a modification of the basic shot cleaning unit, the apparatus is constructed to oscillate the carrier in a vertical plane to an angular extent sufficient to cause the cylinder heads to be displaced longitudinally of the axis of revolution. This additional motion or shaking of the heads about a different axes enhances the shot removal. It also imparts further mechanical shock and vibration to the cylinder heads where the heads are not fixed in position with respect to the longitudinal axis of the carrier and thus can move within prescribed limits and forcibly engage with the carrier to impart the additional vibration and shock along a longitudinal axis of the head. This combination of revolution and axial movement of the cylinder heads, and in the imparting of vibration and shock forces in some cases, is highly effective in the removal of the shot from the internal cavity of a cylinder head and is usually sufficient to effect a one hundred percent removal of the shot.

A further modified apparatus includes a unit that performs only the shaking operation. This shaken unit is utilized in series with a heating unit and a shot blast unit that does not oscillate the carrier and cylinder heads in a vertical plane. The cleaning method thus involves a three step procedure of heating, shot blast cleaning and then shaking to remove the shot from the internal cavities of the heads.

In a further modified form of the invention apparatus, an agitated liquid bath unit is provided in the combination with the cylinder heads subsequent to receiving the shot blast cleaning and the removal of shot through mechanical shaking is sequentially subjected to the agitated liquid bath for further assuring removal of the shot and also treating of the cylinder heads to inhibit rusting. The cylinder heads, having been subjected to heating operation, have substantially all of the oil removed from the metal and consequently, the metal will rapidly oxidize unless otherwise treated. In accordance with this modified form of the invention, the liquid bath to which the cylinder heads are subjected comprises a mixture of water and a water soluble chemical emulsion which results in effective control of rust as well as aiding in removal of any remaining shot during the course of the liquid bath treating operation.

For a highly effective cleaning apparatus and method, the agitated liquid bath unit may be incorporated in sequential treating of the cylinder heads in combination with the heating unit and the shot blast unit having the multi-axis, physical shaking shot removal procedure. The combination of liquid bath with the mechanical vibration shot removal provides treatment of the metal to inhibit rusting, thereby increasing the time that the heads can be stored.

These and other objects and advantages of this invention will be readily apparent from the following detailed description of illustrated embodiments of the apparatus and of the method of performing the cleaning operations.

DESCRIPTION OF THE DRAWING FIGURES

DETAILED DESCRIPTION OF THE ILLUSTRATIVE EMBODIMENTS OF THE APPARATUS OF THE INVENTION

Figure 1:
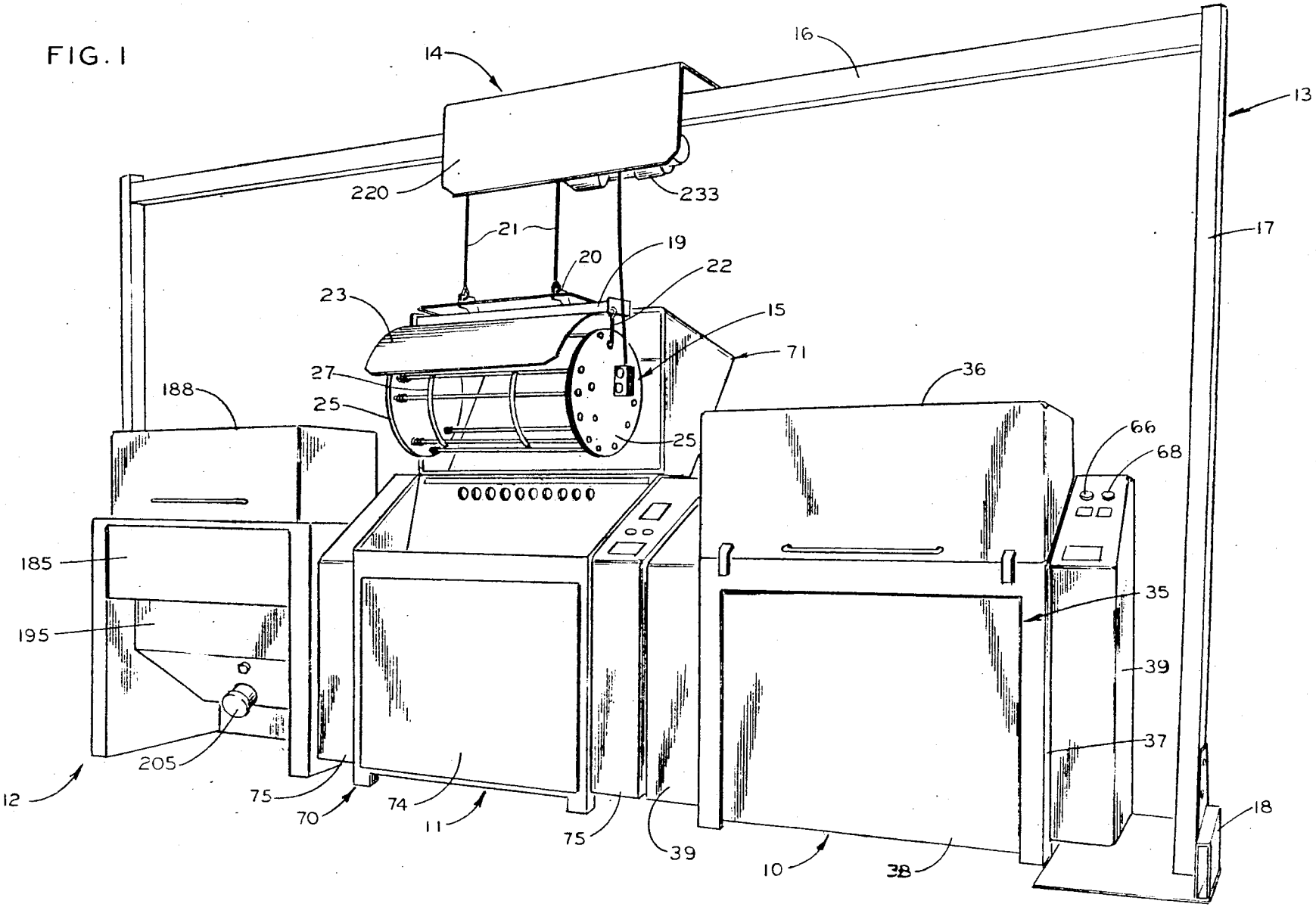
FIG. 1 is a perspective view of the apparatus for cleaning of cylinder heads including a heating unit, airless shot blast unit, liquid agitation unit and mechanical handling apparatus.

FIG. 1 is a perspective view of the several components forming the apparatus of this invention as arranged in functional relationship to each other. These components include a heating unit 10, an airless shot blast unit 11, an agitated liquid bath unit 12 and a mechanical handling apparatus 13 for the transporting of cylinder heads from one of the units to the other. The illustrative embodiments of the apparatus and the method are shown as for cleaning a plurality of cylinder heads at any one stage of the cleaning operation, but it is to be understood that other engine components can be processed by this apparatus and employing the inventive method. The particular apparatus is designed and dimensioned to function with three conventionally sized cylinder heads that are associated with automotive type internal combustion engines, but the apparatus can function with only cylinder head at any one particular stage or any other single automotive engine components. Hereafter, only cylinder heads will be described for convenience of illustration of the apparatus and method of this invention. Obviously, the handling of a plurality of the cylinder heads at any particular stage enhances the economy of operation. In describing the structure and functioning of any of the units incorporated in the apparatus, it will be noted that details of specific electronic or electrical control switches, timers or associated circuitry have been omitted as such components and their associated function are wellknown to those skilled in the art and are not deemed necessary to a disclosure that is sufficient to enable the skilled artisan to practice the invention in either the construction of the apparatus or the method of its utilization.

As will become apparent from the following description of the apparatus, there are two embodiments of the airless shot blast unit 11 that are illustrated and described. These two different units may be alternatively employed as desired in a particular system. It will also be apparent from the following detailed description that the system may not include the agitated liquid bath unit 12 in those instances where one desires to not obtain the further assurance of complete removal of shot from the cylinder heads or to apply a chemical to the cylinder heads to inhibit rusting.

Figure 26:
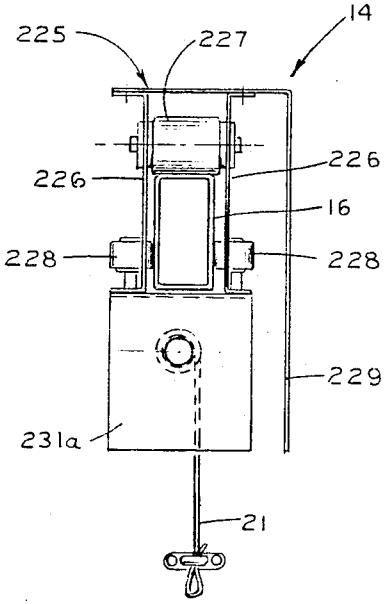
FIG. 26 is an elevational view of the right end of the trolley and hoist components.
Figure 25:
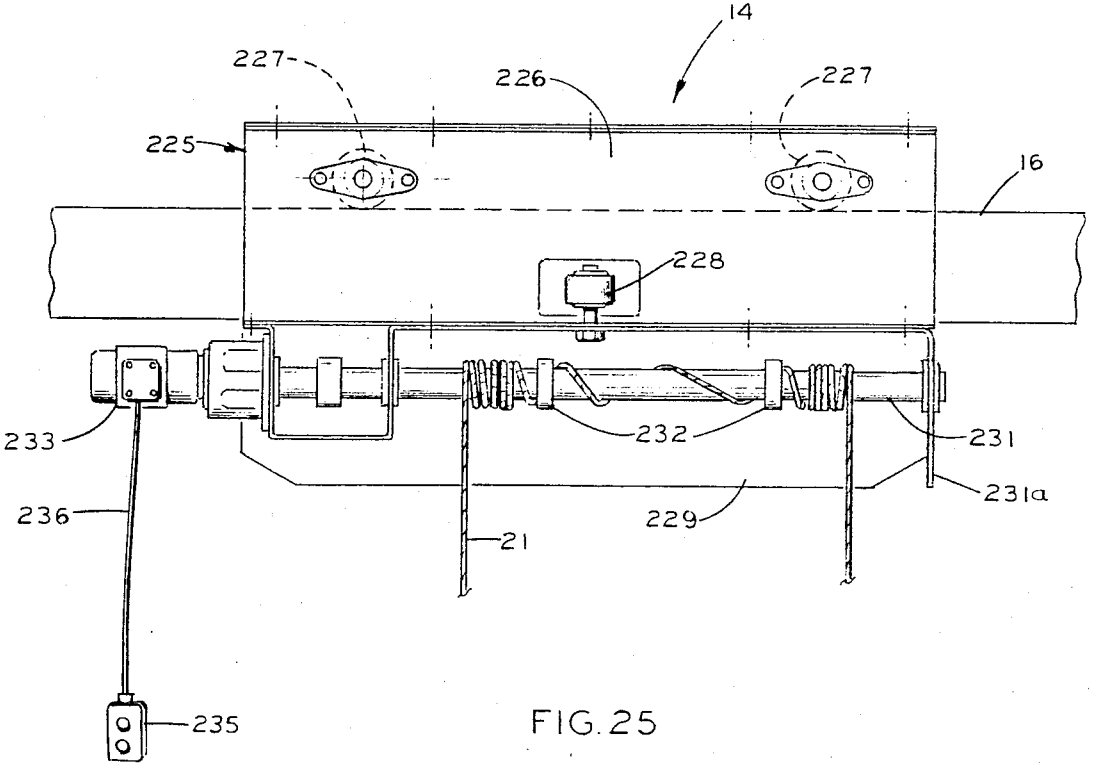
FIG. 25 is a sectional view on an enlarged scale of the trolley and hoist components of the handling apparatus taken along line 25—25 of FIG. 1.

One important aspect of obtaining the advantageous cooperative functioning of the several units incorporated in the system to effect cleaning functions is the handling of the cylinder heads at each unit in performance of the respective function in effecting cleaning and the movement of the cylinder heads from one unit to the other. This is accomplished by the mechanical handling apparatus 13 which, in general, comprises a rail-type conveyor adapted to transport the cylinder heads parallel to longitudinally aligned heating units, shot blast unit and liquid bath units. This rail-type conveyor includes a trolley and hoist unit 14 and a cylinder head carrier 15 adapted to carry a plurality of cylinder heads. Further structural details of a trolley and hoist unit 14 are shown in FIGS. 25 and 26 and will be subsequently described in further detail. It will suffice at this point to note that the trolley and hoist unit 14 is mounted on a horizontal rail 16 carried by the vertical support standards that in turn are mounted on a stabilizing base frame 18. The conveyor rail extends over the top of the several units that are arranged in longitudinally aligned relationship and in the sequence to perform the respective functions in the proper order. It will be noted that the vertical heights of the processing units with respect to the rail permit the carrier 15 to be moved over the top of the units.

Detachable interconnection of the trolley and hoist unit 14 with a carrier 15 is effected by a stabilizer bar which is suspended by means of connector brackets 20 on a pair of hoist cables 21. Mounted on each end of the stabilizer bar 19 are respective ones of a pair of connector hooks 22. These connector hooks 22 are pivotably secured to the stabilizer bar 19 and include a hook-shaped end portion adapted to interfit in respective sockets formed in the carrier 15. To enhance the safety aspects of the apparatus during the course of its operation, a protective shield 23 is provided with the shield being secured to the stabilizer bar 19 and projecting forwardly and downwardly to partially cover the carrier 15 that may be suspended from the stabilizer bar. This shield is of particular importance when removing a carrier loaded with heads that have been heated in the heating unit 10 for transfer to the shot blast unit. As previously indicated, the heads may be heated to a temperature of the order of five hundred degrees Fahrenheit and protection from the heat that can be radiated is of particular importance for workers' comfort and safety.

General functional operation of the mechanical handling apparatus 13 is that a carrier 15 is first loaded with the cylinder heads and this may be advantageously accomplished when the carrier is positioned within the heating unit 10. How that can be accomplished will become apparent from the following further description of the heating unit construction and its function. During the time that the carrier 15 is placed in any one of the units the trolley and hoist unit 14 will be detached and either raised to an inoperative position or employed in the transfer of another similar carrier from one of the other units to either a third unit or to perhaps an unloading station. The apparatus, as illustrated, is constructed on the basis that the loading and unloading of a carrier 15 will be accomplished in the respective heating unit 10 or either of the airless shot blast unit 11 or agitated liquid bath unit 12. It will be apparent that where desired, the rail-type conveyor may be lengthened to provide either a loading station at the right side of the heating unit 10 or an unloading station at the left side of the liquid bath unit 12. It will also be noted that the units 10, 11 and 12 may be arranged in an opposite order with units 10 and 12 interchanged.

In the performance of the different procedures of the cleaning operation, it is the function of the cylinder head carrier 15 to mechanically support the cylinder heads for movement within each of the respective units as well as to maintain the plurality of the heads in relatively spaced relationship to each other during the performance of the several cleaning operations. More specifically, the carrier 15 is of a drum or cylinder-like configuration which is adapted to be supported in each of the respective cleaning units for rotation about a generally horizontal axis. It is contemplated that at least two such carriers will be concurrently utilized in a particular apparatus so that the different sequential steps employed in a particular apparatus may be carried out concurrently and thereby effect the reduction in overall processing time.

Figures 2, 2A:
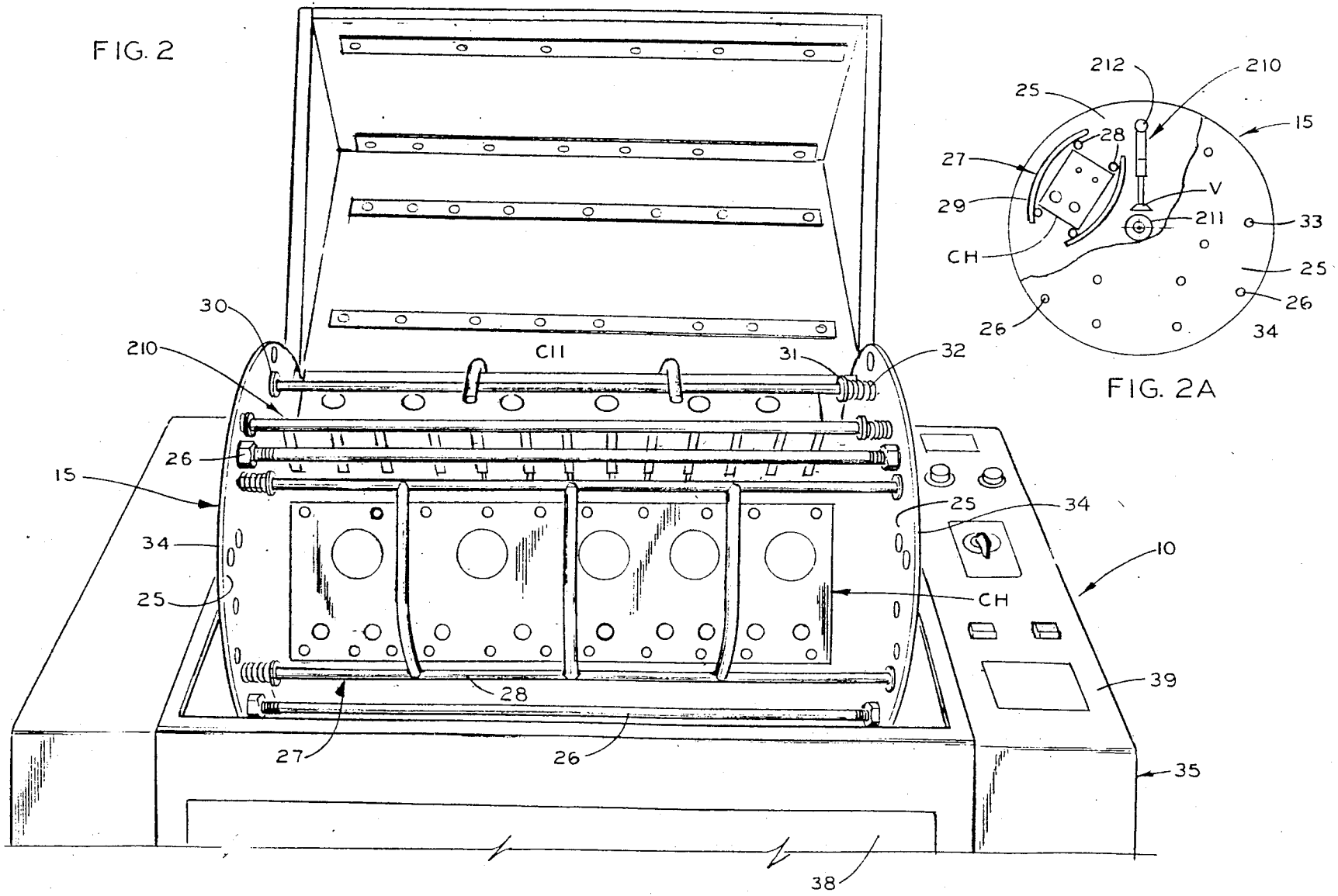
FIG. 2 is a perspective view of the carrier for the cylinder heads on an enlarged scale.
FIG. 2A is an elevational view of the right end of the carrier with portions thereof broken away for clarity of illustration.
Figure 4:
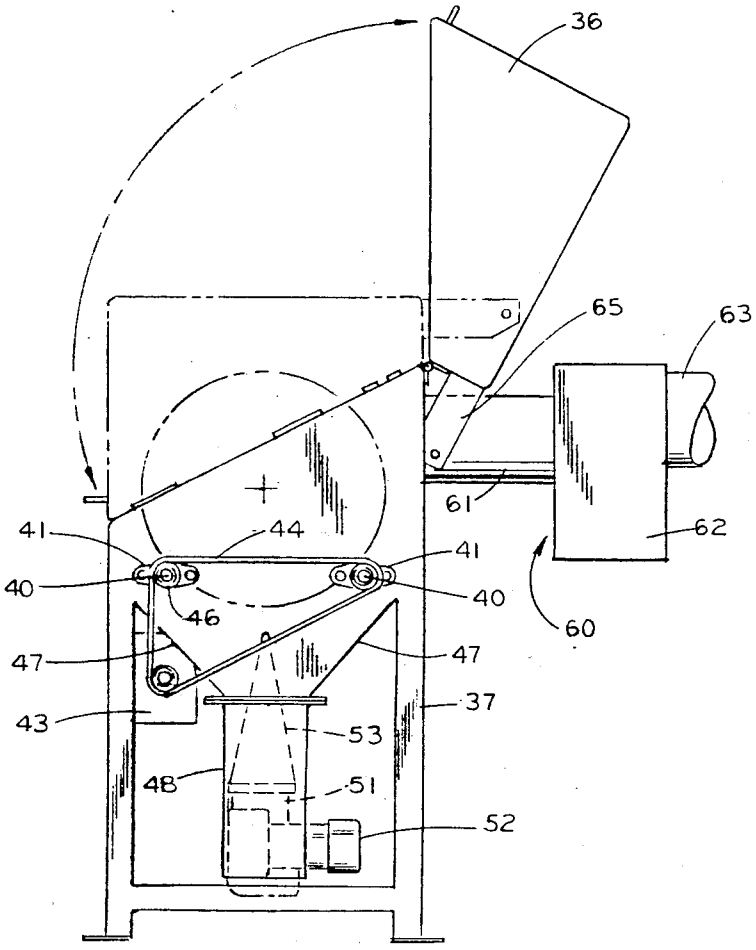
FIG. 4 is a right end elevational view of the heating unit with portions of the cover removed for clarity of illustration.

An illustrative embodiment of a carrier 15 is best seen in FIGS. 2 and 2A. This carrier includes a pair of circular end plates 25 that are interconnected in fixed axially disposed relationship by a plurality of tie rods 26. Several similarly constructed retainer frames 27 are provided and adapted to be assembled with the end plates 25 with pairs of the frames cooperatively forming baskets that receive respective ones of the cylinder heads designated by the letters CH. It will be understood that the cylinder heads CH are of a diagrammatic configuration that is typical of cylinder head structures generally utilized in automotive engines. It will also be understood that the cylinder heads are of an illustrative dimension and cylinder heads of other dimensions may also be utilized with the illustrative carrier. Each of the retainer frames 27 includes spaced axially extending bars 28 that are rigidly interconnected by three longitudinally spaced ribs 29. These retainer frames 27 as can be best seen in FIG. 2A have the ribs 29 configured to cooperatively define with the bars 28 a basket for receiving and retaining therein one of the cylinder heads. Each of the bars 28 of a retainer frame 27 has an end portion provided which is adapted to bear against an interior surface of the one end plate 25. The opposite ends of each of the bars 28 includes an end portion which is provided with a stop flange and a helical compression spring 32 positioned on the end portion of the respective bar axially outward with respect to the stop flange 31. The end plates 25 are formed with a plurality of apertures 33 that are of a size to receive the end portions of the bars 28. These apertures 33 are formed in a predetermined pattern to enable the retainer frames 27 to be selectively positioned with respect to the end plates for properly receiving and retaining a particular dimensioned cylinder head or other components. It will be noted that the retainer frames 27 and their placement with respect to the end plates advantageously permits a limited degree of displacement of a cylinder head within the basket formed by a pair of cooperating retainer frames. This enabling of displacement is of particular advantage in obtaining mechanical vibration and shock forces to enhance the removal of shot from the interior cavities of a cylinder head upon the conclusion of a shot blast cleaning operation in addition to a physical shaking.

Loading of a cylinder head as well as initial positioning of the retainer frames 27 is accomplished by displacing the frames axially to compress the respective compression springs 32 against an end plate 25 of the carrier with the end portions of the rods projected into respective apertures 33 to the extent necessary to permit the opposite end portion of the rods to be fully withdrawn from the respective apertures. By then swinging the retainer frame outwardly, it is possible to fully remove a retainer frame by permitting the compression springs to move the bars 28 in the opposite direction and to then fully remove the bars from the respective apertures in the opposite end plate 25. It can be readily seen that with the carrier positioned such that one basket that would be formed by a pair of retainer frames 27 is located in a generally top position that one can either remove or position a cylinder head in that basket concurrently with the cooperative removal of the outermost retainer frame. By appropriate location of the apertures 33 and cooperative dimensioning of retainer frames 27, it is possible to utilize a carrier for different sized cylinder heads with the basket configurations formed by their pairs of retainer frames being most appropriate for a particular dimensioned cylinder head. The carriers 15 are intended to be loaded and unloaded while positioned in one or the other of the units 10, 11 or 12 or the other modified or alternative units described herein and illustrated in the drawings. When thus positioned in the units, the carrier can be revolved to a Position convenient for loading or unloading. For purposes which will be explained hereinafter, each of the end plates 25 is formed with a circular peripheral edge 34 that is disposed a distance radially outward with respect to any of the retainer frames or portions of cylinder heads CH that may be contained within respective pairs of retainer frames 27.

An illustrative embodiment of a heating unit 10 embodying this invention is shown in FIGS. 3-6. The heating unit 10 includes a base section 35 and a cover section 36. The base section 35 incorporates a structural supporting frame (not illustrated in detail) and is provided with a protective shell 37. A front panel 38 of this shell is removed in FIG. 3 to permit better illustration of the internal components. Similarly, the end cover 39 has been removed from the right end to also enhance illustration of the mechanical operating components. The top of the base section 35 and associated cover section 36 are configured to be pivoted for opening along a horizontal hinge line at the rear of the structure with the front of the cover section having a substantially greater vertical extent and thus resulting in better exposure of a carrier 15 that is positioned within the unit. Each of the end covers 39 provides protection as to various operating components and the control elements.

Support for revolution of the carrier 15 in the heating unit about a horizontal axis is provided by a pair of horizontally extending support rollers 40. These support rollers 40 are journalled in bearings 41 mounted on the structural frame of the unit with the pair of rollers 40 being disposed in a horizontal plane but spaced apart a predetermined distance. Each of the rollers 40 is provided with a pair of drive sleeves that are longitudinally spaced apart a distance equal to the spacing of the circular end plates 25 of a carrier. Each of the sleeves 42 advantageously has its outer surface provided with a knurled surface to better enhance frictional engagement with a peripheral edge 34 of the respective end plate as a carrier is positioned in the heating unit with the end plates resting on these sleeves and thus supported by the rollers 40.

Revolution of the carrier 15 is effected by an electric motor 43 mounted on the structural frame of the base section 35 and drivingly coupled with each of the support rollers by a flexible belt 44 trained around a pulley 45 mounted on the output shaft of the motor 43 and respective pulleys 46 mounted on the ends of the support rollers 40. The rotational speed of the carrier is not of a critical nature, however, the carrier is advantageously revolved in the range of 15-20 revolutions per minute. The optimum speed is determined in part by the condition of the cylinder heads being processed and their dimensioning A motor 43 is selected with a suitable gear reduction drive to obtain the desired rotational speed. The upper portion of the interior of the base section 35 is of a depth and width to receive the carrier with the bottom walls 47 being convergent along the longitudinal axis and forming a relatively narrow debris receiving chamber 48. The heating process may not result entirely in the production of gaseous combustion components that may be exhausted through a suitable venting system. Debris in the form of solid components and particles may be produced and fall from the cylinder heads during the course of the heating operation and this debris is collected in the chamber 48 for subsequent disposal. For this purpose, the chamber 48 is advantageously constructed to be detachable from the unit to facilitate the subsequent disposal of such collected particles. It is to be noted that although this debris may not be completely burned, it will not continue to burn in the chamber 48 due to a lack of oxygen and therefore this debris does not present a safety problem.

Positioned centrally of the base section in underlying relationship to the upper section in which a carrier 15 may be positioned is a burner unit 50 for generating of an open flame which is directed onto the cylinder heads carried by the carrier 15. The illustrative burner unit 50 is designed for operation with natural gas, although burner units adapted to use propane gases or other suitable fuels may be utilized. This unit is advantageously of a construction adapted for automatic operation and includes electrical ignition and associated electrical controls commonly available with commercially available units of this type to be capable of automatic operation. The burner unit 50 includes a combustion chamber 51 and is also provided with a blower 52 to assure a sufficient supply of air for efficient combustion in producing the concentrated high quantity of heat necessary to rapidly heat the cylinder heads. Since the cylinder heads are of an elongated configuration, it is advantageous to also provide a flame spreader 53 at the outlet of the combustion chamber 51 for directing the flame in an upward direction and within a narrow elongated space. For this purpose, a flame spreader 53 is provided comprising a housing which includes a bottom end 54 adapted to be interconnected with the outlet of the combustion chamber and sidewalls of a V-shaped configuration which converge inwardly in an upward direction to define a narrow elongated outlet 56 which extends longitudinally of the oven unit in centered relationship to the longitudinal axis of the carrier 15. A flame control device 57 is also advantageously provided in the flame spreader 53 to effect a uniform distribution of the flame along the entire length of the outlet 56. This flame control device 57 is illustrated as comprising a V-shaped diverter bar extending transversely between the opposed sidewalls 55 immediately above the outlet from the combustion chamber 51 and two selectively adjustable regulator plates 59. Each regulator plate is independently movable and they are positioned in spaced relationship to the end walls 55a forming respective passages of predetermined area to obtain a diversion of the flame in equal quantity to each side to obtain the uniform flame pattern at the outlet 56.

Combustion gases generated within the heating unit 10 are vented through an exhaust system 60 appropriate for maintaining the applicable air quality standards. Such an exhaust system 60 may include a vent pipe 61 connecting directly to the interior of the heating unit and communicating with an auxiliary device to assure complete combustion of the by-products generated in the heating unit. This auxiliary device may be of a type generally referred to as an afterburner 62 with the function of effecting complete combustion of the products generated in the heating unit prior to ultimate exhausting to the atmosphere through a vent pipe 63. The afterburner would also be provided with a fuel supply and the necessary controls and apparatus for effecting this further combustion and interconnected into the control system of the heating unit for operation in cooperation with that unit.

The interior of the heating unit in which the carrier 15 is Positioned and the interior of the cover section 36 are preferably Provided with an interior facing of a fire resistant insulating material. This fire resistant heat insulating material is indicated to be in a sheet-form 64 applied to the interior surfaces of the unit. The cover section 36 is fabricated from a sheet metal and thus presents a significant weight problem which is compounded through the added weight of the insulation material 64 applied to the interior surfaces. To counteract this weight problem in facilitating opening and closing of the cover a counterbalancing weight 65 is advantageously secured to the rear side of the cover.

Figure 3:
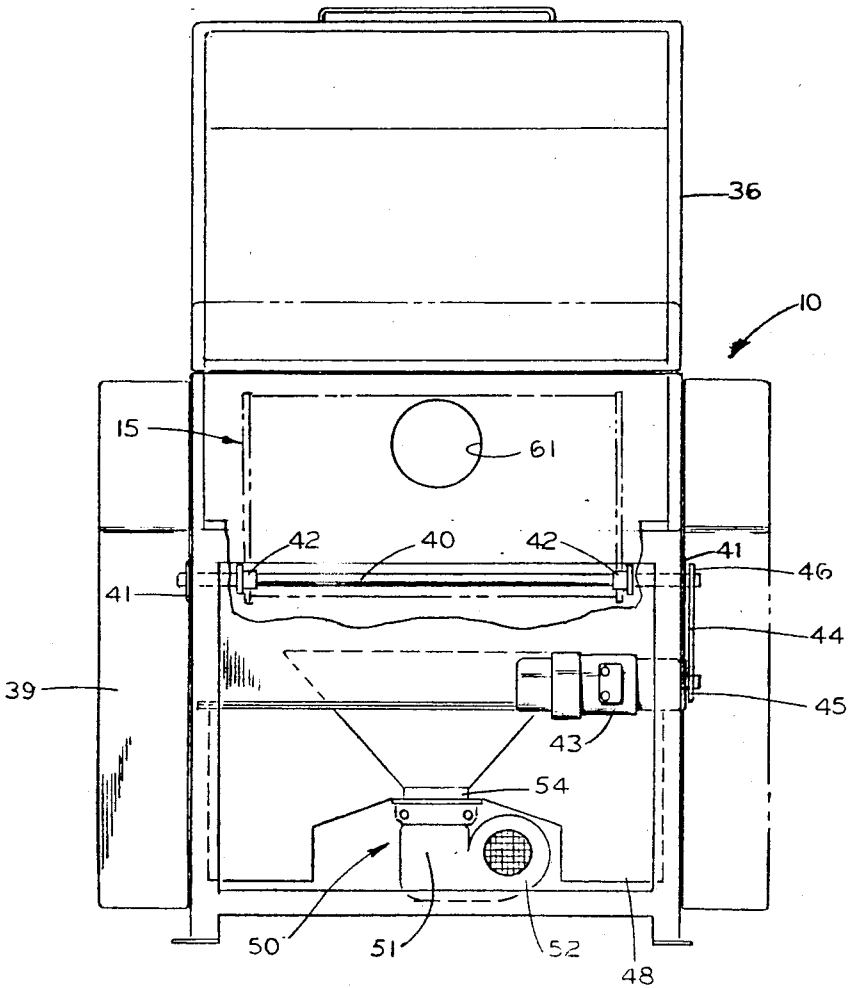
FIG. 3 is a rear elevational view of a heating unit.
Figure 5:
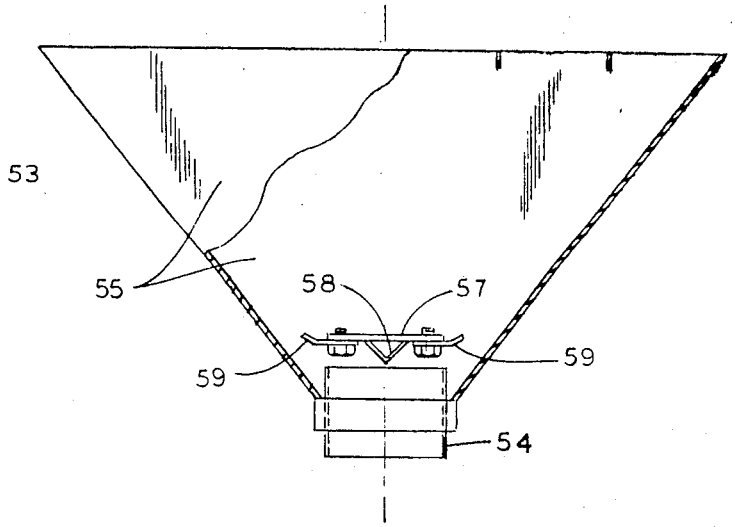
FIG. 5 is a front elevational view on an enlarged scale of the burner in the heating unit.
Figure 6:
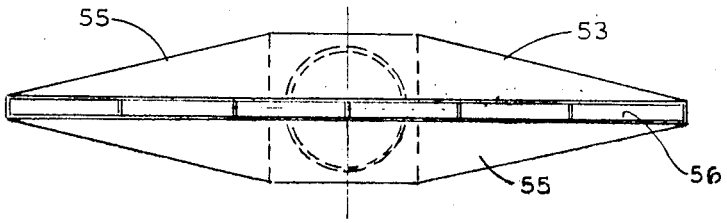
FIG. 6 is a top plan view of the burner.
Figure 8:
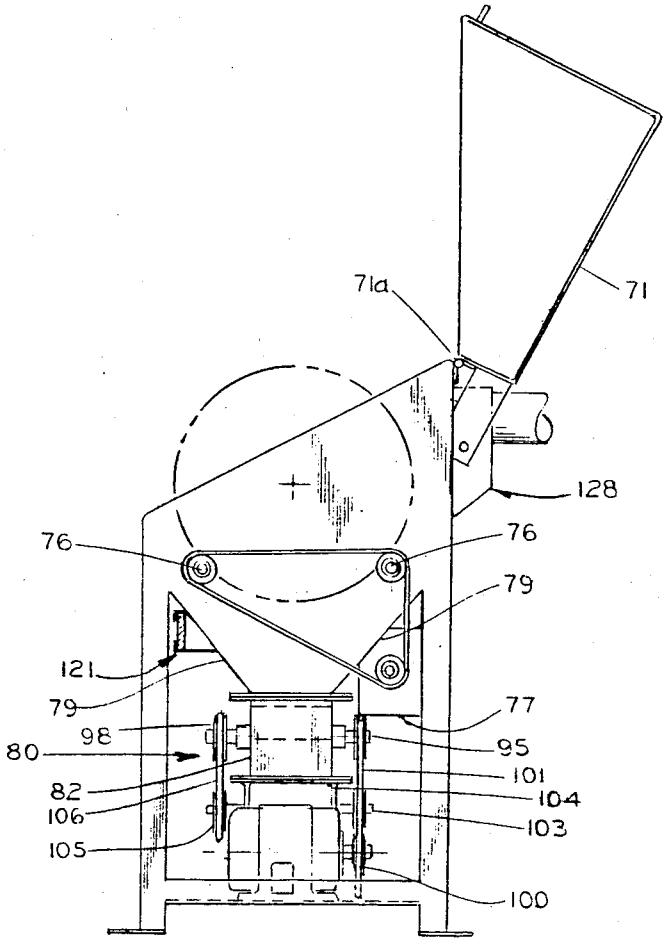
FIG. 8 is an elevational view of the right end of the shot blast unit.

Controls for operation of the heating unit 10 are only diagrammatically indicated in FIGS. 1 and 3. These controls would include the basic operating function controls for starting of the unit and timing of its operation. Safety controls would also be incorporated along with appropriate indicators as to the temperature and any other operating factor that would be appropriate for monitoring of operation. These basic controls and indicators are indicated in the drawings by the numerals 66 and 67 and are not otherwise illustrated or described as their construction, installation and functioning are well-known to those skilled in this art. Safety controls would include appropriate temperature sensing devices interconnected in the control circuitry to assure that maximum permissible temperature limits in the various components are not exceeded. A timer unit 68 would also be incorporated in the system to obtain automatic functioning of the unit with the cycle time being of the order of 15 to 20 minutes for effective burning of the scale and other products that are normally found on cylinder heads of this type. The timer 68 would include a setting control that is accessible on the exterior of the one end cover 39 as is the starting control 66.

Upon completion of the heating operation, the cylinder head carrier 15 loaded with the heads is removed from the heating unit 10 and transferred to the airless shot blast unit 11. As previously indicated in describing the structure and function of the mechanical handling apparatus 13, this is readily accomplished by opening the cover section 36 of the heating unit, thereby exposing a substantial upper portion of the carrier and facilitating attachment to the connector hooks 22 of the handling apparatus. Operation of the trolley and hoist unit 14 then enables the operator to lift the loaded carrier 15 from the heating unit and to then transfer it horizontally into a proper position over a shot blast unit where it can be lowered into the interior of that unit. This may be accomplished without waiting for any cooling of the cylinder heads prior to positioning the carrier in the shot blast unit.

A basic airless shot blast unit 11 embodying this invention is best shown in FIGS. 7–12 of the drawings. This unit is similar to the heating unit in basic structure and includes an open top base section 70 and a cover section 71 pivoted on the base section by a hinge **71*a* for swinging movement between the illustrated open position of FIGS. 7 and 8 and a closed position similar to that of the heating unit 10 as shown in FIG. 1. Similar to the heating unit, the shot blast unit 11 also has the upper end of the base section and bottom of the cover section configured to result in a substantial portion of the upper part of the carrier 15 being exposed when the cover is swung to an open position. As explained with respect to the heating unit, the purpose of this configuration is to provide greater accessibility for attachment of the connector hooks 22 with the end plates 25 of the carrier. Opening and closing of the cover section 71 by the operator is also facilitated by the attachment of a counterweight 72** to the rear side of the cover section.

Incorporated in the base section 70 is a structural frame 73 that is not described in further detail with the front panel 74 and end cover 75 removed to permit illustration and description of other internal components of the unit. The front panel 74 provides protection as to the internal working components with the end cover 75 not only providing such protection to the operator, but also forming a supporting base for several of the actuating controls and indicators.

Support of a cylinder head carrier 15 in the shot blast unit for revolution is effected by mechanisms similar to that dsecribed with respect to the heating unit 10. These structures include a pair of horizontally disposed support rollers 76 that are drivingly coupled with an electric driving motor 77 by a flexible belt 78.

The upper portion of the base section is constructed to define in cooperation with the cover section 71 a closed chamber in which the carrier 15 is positioned with its cylinder heads and into which the shot is thrown to effect removal of debris from the cylinder heads. The bottom of this chamber formed in the base section comprises two longitudinally extending sidewalls 79 which converge inwardly in a dowdward direction, thus forming a V-shaped hopper. This V-shaped hopper extends the full length of the unit in underlying relationship and centered with respect to the longitudinal axis of the carrier 15 as it is supported on the respective rollers 76. The sidewalls 79 do not intersect and cooperatively define a longitudinadinally extending, rectangularly shaped opening through which the shot is thrown upwardly into the chamber.

Supported below the chamber and communicating with the rectangular opening thereto is a shot throwing unit 80. As can be best seen in FIGS. 9 and 10, this shot throwing unit 80 is of the airless type and utilizes two shot throwing rotor units 81 to mechanically throw the shot upwardly into the chamber to contact with the cylinder heads carried in the revolving carrier. The rotor units 81 are mounted on a supporting frame 82 that comprises a peripheral vertical wall 83 of elongated rectangular shape to match the opening at the bottom of the chamber. A bottom plate 84 is secured to the lower ends of the vertical wall 83 thereby forming a rectangularly shaped channel into which the shot is placed, thus functioning as a reservoir to feed the shot into the respective rotor units 81. A partitioning wall 85 is centrally disposed in the frame 82 and extends transversely between the two longitudinally extending wall elements. This partitioning wall 85 is disposed equidistantly between the two rotor units 81 that are located adjacent respective opposite ends of the supporting frame and is advantageousl formed with an inverted V-shaped upper surface 86. As will become apparent from further description of the apparatus and its functioning, this partitioning wall 85 assists in the return of shot in generally uniform proportions to each of the two rotor units 81. Extending around the upper ends of the peripheral wall 83 is an outwardly projecting flange 87. This flange 87 mates with and is secured to a similar flange 88 formed on the bottom of the chamber walls 79 and its interconnectin end walls and provides a means for mechanically interconnecting the shot throwing unit with the other structural components such as by bolt-type fastening devices.

Figure 7:
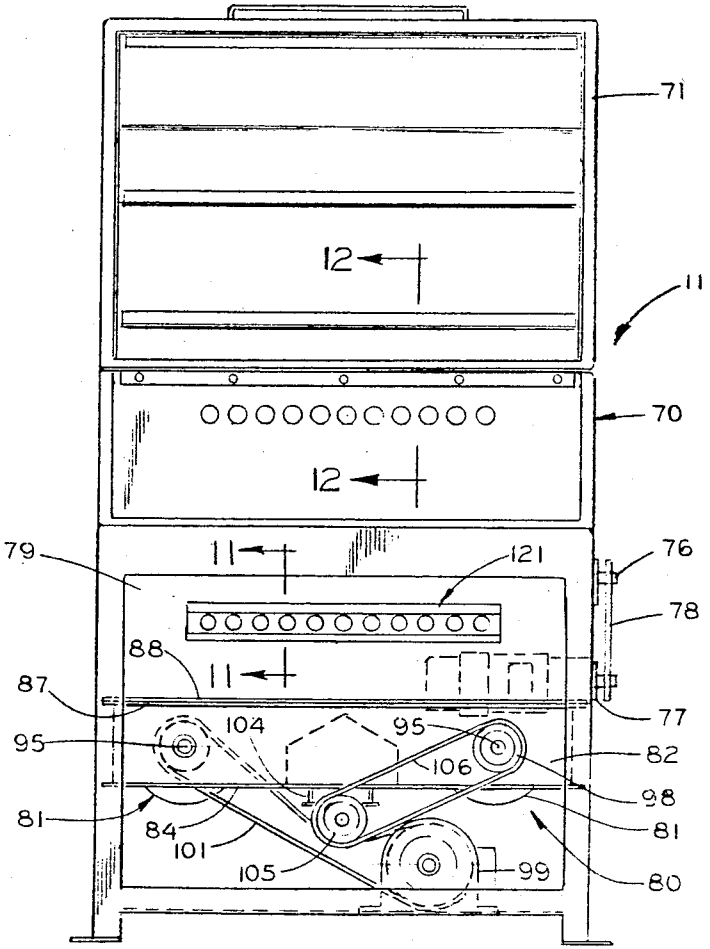
FIG. 7 is a front elevational view of an airless shot blast unit.

Each of the shot throwing rotor units 81 is of a similar construction, although they are oriented in opposite directions so that the shot will be thrown in opposite directions by the respective units. Each rotor unit comprises a cylindrical housing 89 having a peripheral wall 90 closed at each side by circular end plates 91. Positioned in the interior of the housing is a rotor 92 which in the illustrative embodiment comprises a set of four flat blades 93 that are secured to a hub 94 and which hub in turn is mounted on an axle 95. The axle 95 extends axially outward from each side of the housing through apertures 96 and the opposite ends thereof are journalled in bearings 97 mounted on the vertical wall 83 of the supporting frame 82. A drive pulley 98 is mounted on one end of each axle 95 outwardly of the frame wall 83, but at opposite sides of the frame wall for interconnecting with a power source which in this illustrative embodiment comprises an electric motor 99. The motor 99 is provided with a pulley 100 and is coupled with one of the rotor pulleys 98 by a flexible belt 101. This belt 101 also engages with a first pulley 102 mounted on a jack shaft journalled in a bearing structure 104 that is secured to the bottom of the frame 82. This jack shaft 103 extends to the opposite side of the supporting frame and carries a second pulley 105 that is mechanically coupled by a flexible belt 106 to the drive pulley 98 of the other rotor unit. With the illustrative arrangement, the belt 101 from the motor 99 drives the jack shaft 104 through its being coupled with the pulley 102 as well as the pulley 98 that drives the one rotor unit. This arrangement as shown in FIG. 7 results in revolving of the rotors 92 of each of the two units in respectively opposite directions.

Each of the two rotor units 81 has the respective cylindrical housing 89 secured to the bottom plate 84 as by welding. These housing are thus oriented in vertical planes that are longitudinally aligned and each cylindrical wall 90 is formed with an opening defined by end edges 110 with this opening having an angular extent of approximately a 90 degree arc. This opening is oriented along an axis that is angled upwardly at an angle of about 45 degrees to the horizontal and relatively inward of the adjacent end of the frame. Mounted on the rotor housing 89 adjacent the end edge 110 that is most nearly vertically positioned is a shot cut off plate 111. This shot cut off plate is secured to a U-shaped mounting bracket 112 having its end flanges extend radially inward over the respective circular end plates 91 of the housing. Mechanically securing this bracket 112 and its associated cut off plate 111 to the housing are a pair of clamp bolts 113. This mounting structure enables selected positioning of the cut off plate 111 to place its end edge 114 at a desired position to assure that no shot will be thrown along a path beyond this limit as well as facilitating replacement in the event of exeessive wear.

Figure 9:
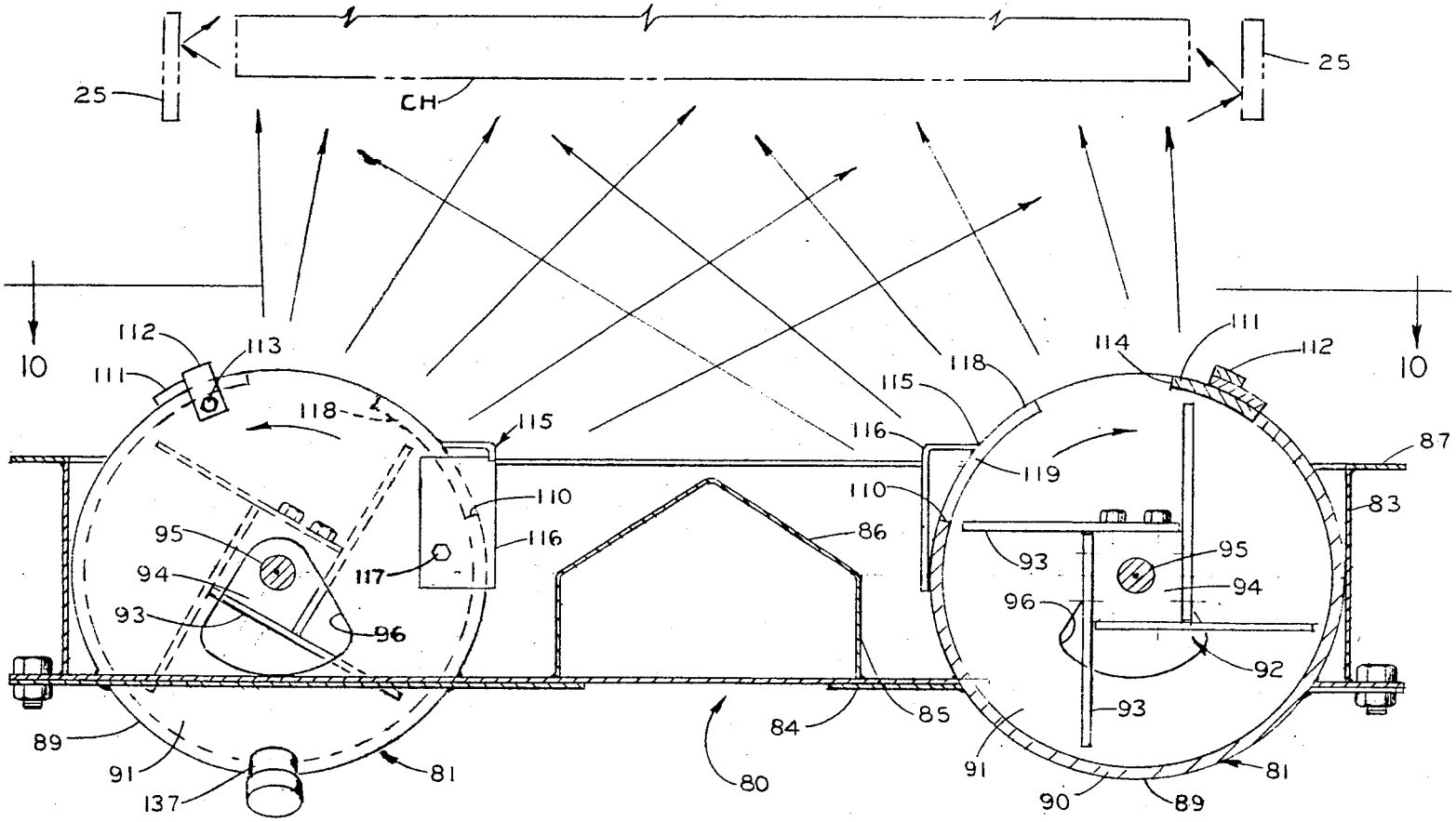
FIG. 9 is a fragmentary sectional view of the shot throwing rotors on an enlarged scale taken along line 9—9 of FIG. 10.
Figure 10:
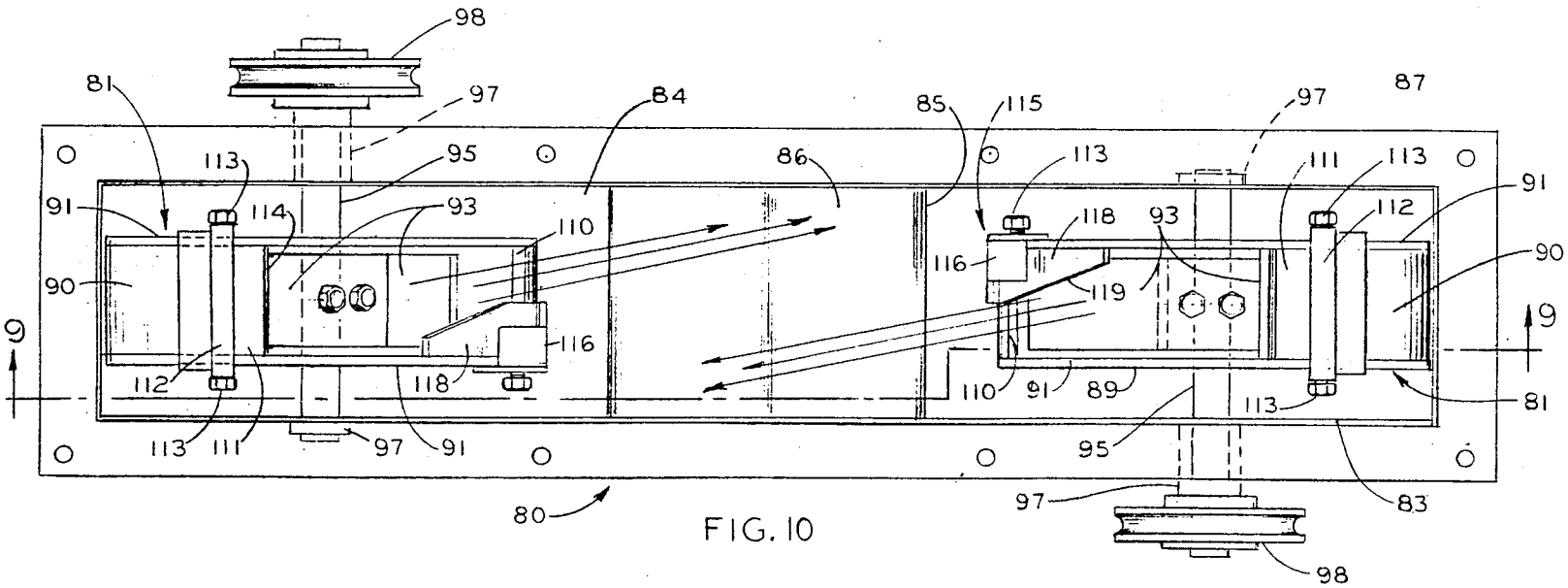
FIG. 10 is a top plan view of the shot throwing unit as seen along a plane taken on the line 10—10 of FIG. 9.
Figure 12:
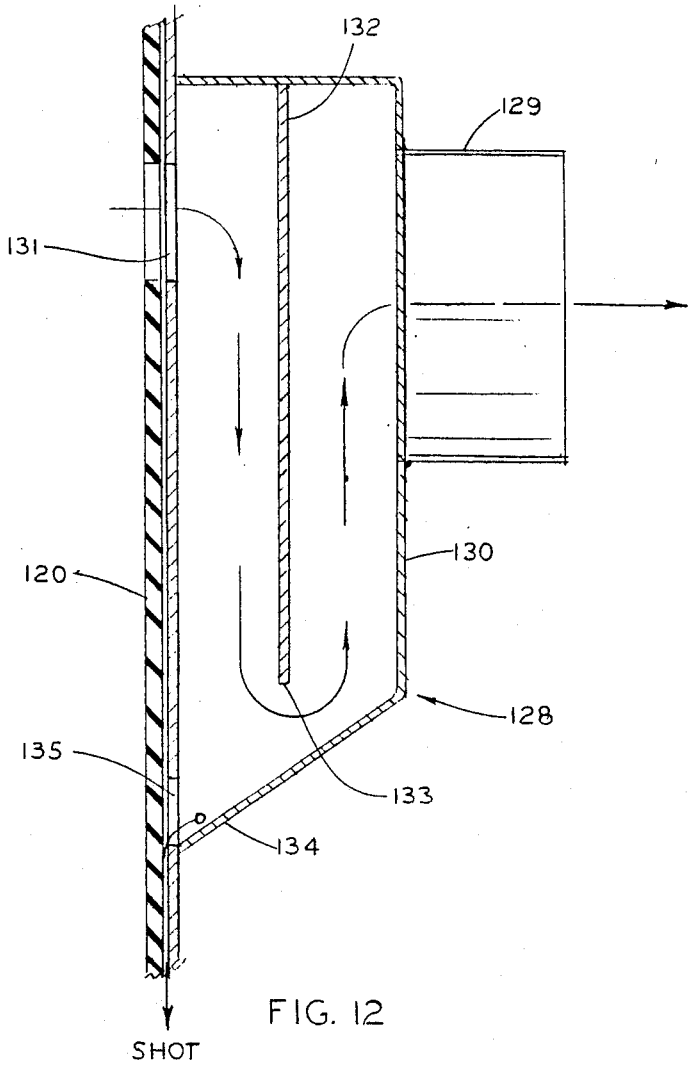
FIG. 12 is a fragmentary sectional view on an enlarged scale taken along line 12—12 of FIG. 7.
Figure 11:
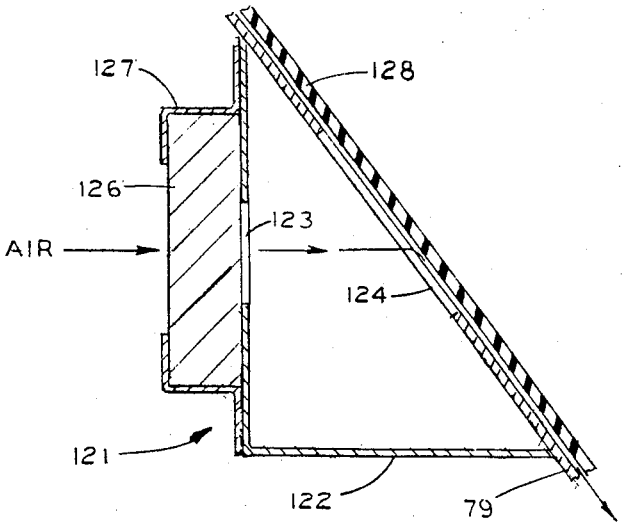
FIG. 11 is a sectional view on an enlarged scale taken along line 11—11 of FIG. 7.
Figures 13, 14, 15:
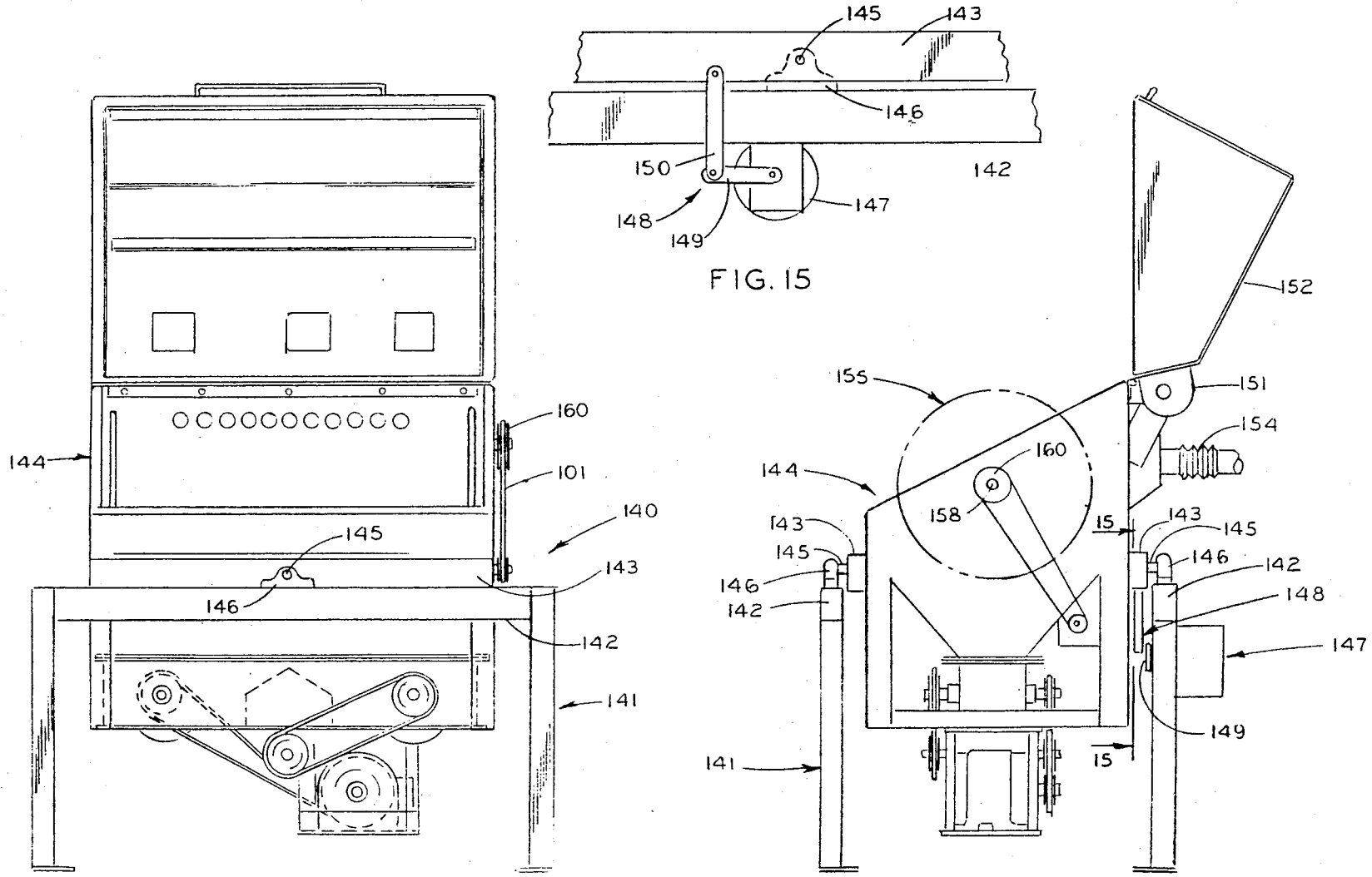
FIG. 13 is a front elevational view of a modified shot blast unit with portions thereof broken away for clarity of illustration.
FIG. 14 is an elevational view of the right end of the modified unit shown in FIG. 13 also with portions thereof broken away for clarity of illustration.
FIG. 15 is a fragmentary sectional view taken along line 15-13 15 of FIG. 14.
Figure 16:
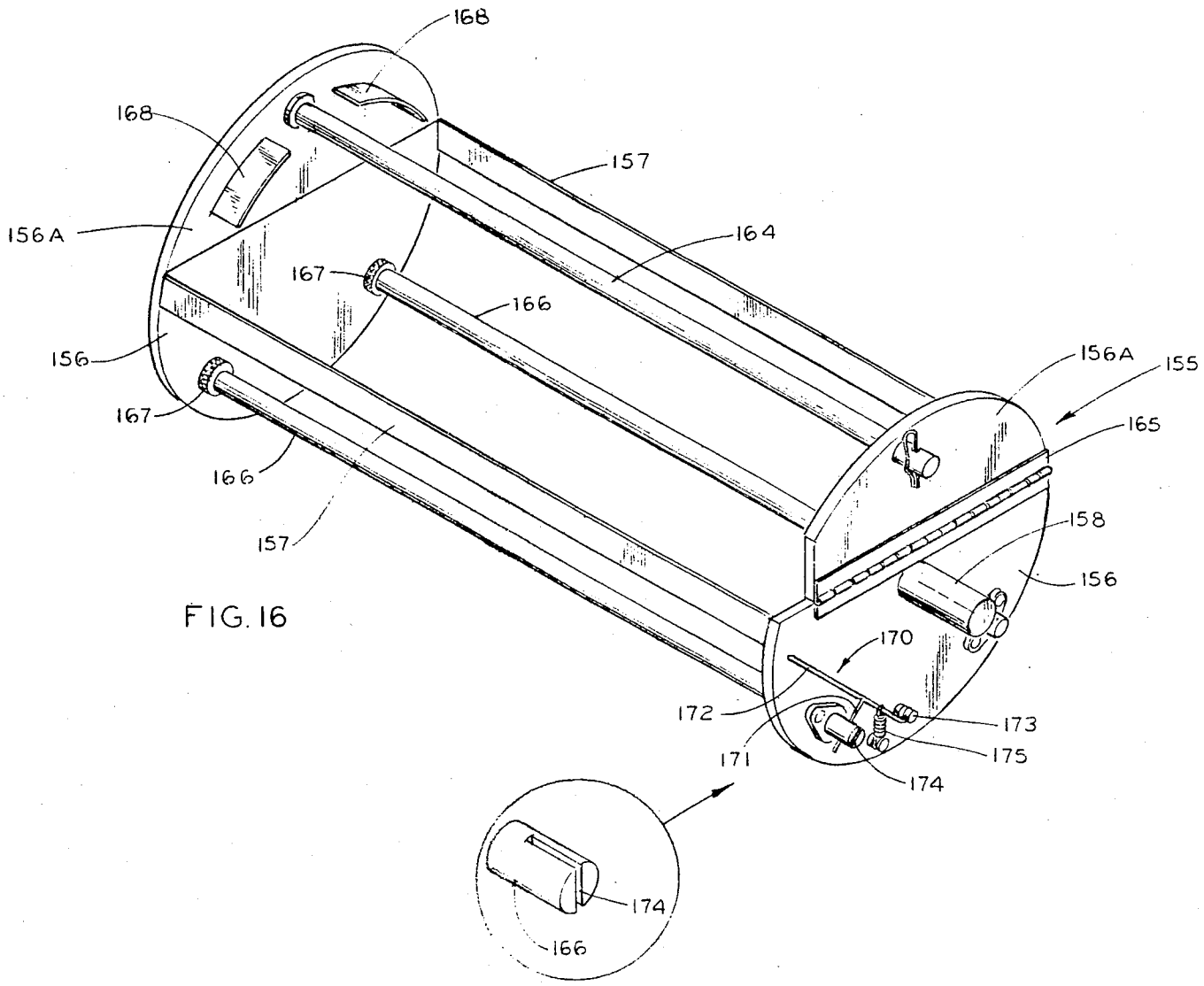
FIG. 16 is a perspective view of the carrier cage.

Mounted on the rotor housing 89 at the opposite side of the opening is a diverter plate assembly 115. This assembly 115 includes a mounting bracket 116 adapted to be mechanically secured to the one circular end plate 91 as by means of a mounting bolt 117. Carried by the bracket 116 is a diverter plate 118 having an arcuate configuration to conform to the circular peripheral edge of the housing. The diverter plate 118 projects a distance axially over the opening and terminates in an angular edge 119 with the plate having the greatest width in the region of the adjacent end edge 110 of the housing opening. The angular edge 119 converges toward the end plate 91 on which the assembly is mounted. The function of the diverter plate assembly 115 is to direct the path of the shot that is thrown from the respective rotor units. The shot flows into each housing 89 of a rotor unit through the aperture 96 which, as can be seen in FIG. 9, is configured to assure that the shot will not be impeded as it flows into the interior of the housing. As the rotors 92 revolve, the respective blades 93 engage with the shot that has flowed into the interior of the housing and causes the shot thus engaged to be thrown by centrifugal force outwardly through the opening of the housing. As the shot by any particular blade 93 approaches the opening, it will first be controlled by the diverter plate 118 which is effective in causing the shot to be directed in a lateral direction as can be best seen in the schematic illustration of FIG. 10. In effect, the diverter plates 118 result in the flow path of the shot from each rotor that is in a noninterfering relationship to the flow path of shot from the opposing rotor unit. Also as is schematically illustrated in FIG. 9, it can be seen that the shot as it is thrown upwardly from the shot throwing unit 80 into the chamber where the cylinder head carrier 15 is positioned results in the shot being directed against all surfaces of the cylinder heads. Some of the shot will ricochet from the end plates 25 of the carrier 15 and thereby be directed against the end walls of a cylinder head. Since the carrier is being revolved, all surfaces of the cylinder heads will be exposed to the direct contact by the shot being thrown upwardly from the shot throwing unit.

The size of shot that is used in any cleaning operation is dependent in part upon the material from which the cylinder heads are manufactured. It has been found that a shot having a mesh size of 170 is suitable for cleaning of cast iron cylinder heads where the rotors 92 are revolved at about 2600 r.p.m. For aluminum cylinder heads, a shot size of the order of 210 has been found appropriate.

To provide protection for the interior surfaces of the chamber in which the carrier 15 is positioned, it has been found advantageous to line those surfaces with sheets 120 of resilient material such as rubber. The sheets of resilient material not only provide physical protection for the structure, but also result in a significant reduction in the noise that is otherwise produced by the shot.

Operation of the shot blast unit 11 results in the production of dust and airborne particles of debris that is removed from the cylinder heads. It is desirable to remove the dust and other airborne particles and to collect them for appropriate disposal. For this purpose, the base section 70 of the unit is provided with an air inlet 121 which is mounted on one sidewall 79 and best seen in FIG. 11. This air inlet unit 121 includes a longitudinally extending entrance plate 122 having a series of apertures 123 formed therein and through which air flows into the interior of the unit. The wall 79 is also provided with a similar set of apertures 124, but it will be noted that there is no direct communication to the interior of the chamber. The protective sheet of resilient material 120 overlies the apertures 124 in the wall 79 resulting in the incoming air flowing downwardly between the wall and protective sheet. The portion of the protective sheet 120 overlying the walls 79 is not secured to the lower portions and the incoming air flows into the chamber around the bottom edge of the sheet adjacent the bottom opening to the shot throwing unit 80. A porous filter element 126 is positioned in a holder frame 127 at the outside of the apertures 122.

A baffled exhaust 128 is provided at the rear of the base section 70 through which the air with entrained dust and other particles may be withdrawn: through a vent 129 to a suitable separator device (not shown) and which may be of any commercially available type suitable for the particular debris to be collected. A blower unit also not shown would be provided to assure a continual flow of air through the chamber and removal of the dust and other particles. This baffled exhaust 128 as can be best seen in FIG. 12 comprises an elongated housing which extends longitudinally along the rear wall of the upper portion of the base section 70. A plurality of apertures 31 are formed in the rear wall of the base section and through which the air flows into the housing 130. The housing is provided with a centrally disposed baffle plate 132 that extends longitudinally through the housing and is secured at its upper end to the top of the housing. The baffle plate 132 terminates at a horizontal bottom edge 133 that is spaced a distance upwardly from a bottom wall 134 of the housing. Airflow thus follows a path which is at first downwardly as it enters the housing 130 and then upwardly and subsequently through an outlet into the vent 129. Since it is possible for shot to also enter through the apertures 131, it is advantageous to provide a return for the shot which will thus be collected in the housing 130. This is accomplished by forming a series of apertures 135 in the vertical rear wall of the base section in closely adjacent relationship to the bottom wall 134 of the exhaust housing. The shot being relatively heavy as compared to the entrained dust and contaminant particles will merely fall to the bottom wall 134 and roll downwardly along this inclined wall through the apertures 135 and thence downwardly through the chamber between the wall 79 and protective sheet 120 and return to the shot throwing unit 80.

Although not shown, it may be desirable to interpose a spark arrester between the baffled exhaust 128 and a dust and particle separator device. A spark arrester is important in any installation where the cylinder heads at the elevated temperature are immediately transferred from the heating unit 10 to the shot blast unit. The reason is that the shot cleaning may result in particles of ash or debris at this elevated temperature being entrained in the airflow exhausted from the unit and which could otherwise create a fire hazard.

Solid particles of debris removed from the cylinder heads fall downwardly and are collected along with the shot in the shot throwing unit 80. It is thus necessary to periodically remove the shot for cleaning and removal of the debris. For this purpose, each of the rotor units 81 has an outlet 137 provided at the bottom of the respective cylindrical housing 89. Each outlet 137 is provided with a closure plug 138 which can be removed and permit the shot and other debris to be removed.

While the mechanical operation of the several components of the shot blast unit 11 have been described as related to their structure the procedure and operation of the unit for effecting cleaning has only been briefly noted. It has been noted that a carrier 15 containing the cylinder heads is positioned in the unit upon opening of the cover section 71 and lowering of the carrier onto the supporting rollers 76. Upon closing of the cover section, the apparatus is then started to cause the carrier 15 to be revolved and the shot throwing unit 80 to function in throwing shot upwardly and against the cylinder heads. The shot throwing is continued for a predetermined period of time which may be of the order of ten to fifteen minutes to remove the now dry debris and scale that remain adhered to the surfaces of the cylinder heads. This time of operation of shot blast is altered in accordance with the condition of the particular cylinder heads or other component being processed. It will be noted that during the course of the shot blasting procedure, the cylinder heads are also revolved about a horizontal axis thereby assuring that all surfaces of the cylinder heads are relatively exposed to the upwardly thrown shot for optimum cleaning. Where multiple components such as cylinder heads are positioned in a carrier for simultaneous processing, it is important to position these components relative to each, and limit their number, so that the shot can be effectively thrown against the components revolving through the upper arc of movement as well as when revolving through their lower arc. This relatively free path for enabling the shot to reach all surfaces of the components can be readily seen in FIG. 2A.

Upon completion of the shot cleaning operation, the shot throwing unit 80 is turned off, but the carrier 15 is advantageously continued to be revolved for a predetermined period of time. The objective of continuing to revolve the carrier is that this provides a means for effecting removal of shot which may be retained within the various cavities of the cylinder heads. The continued revolution of the carrier results in the repetitive movement of the component to different orientations with the various surfaces and cavities thus being revolved through repetitive cycles of 360 degree changes in their orientation to a reference. This changing in orientation with the carrier being revolved at a speed in the range of 15-20 r.p.m. is equivalent to physically shaking the components to dislodge and enable the shot to roll out of the various cavities. In those cases where the components are not rigidly fixed in the carrier, there will also be mechanical shock forces applied to the comoponents and these forces that will vibrate and jar loose the shot which may be retained in those cavities thereby aiding in effecting removal of the shot. This continued revolution of the carrier extends for a predetermined time is deemed appropriate for effecting the removal of the shot.

A modified airless shot blast unit 140 is illustrated in FIGS. 13, 14, 15 and 16. This modified unit embodies a large number of structural components of the unit shown and described in conjunction with FIGS. 7–12 and reference may be had to that description and illustration for structural and functional features. This modified airless shot blast unit, in essence, comprises the shot blast unit 11 previously described, and an auxiliary frame 141 upon which that unit is mounted. This auxiliary frame includes front and rear longitudinally extending support rails 142 with the frame structure of the basic shot blast unit being modified to eliminate its supporting leg structure and provide a mounting axle. This is accomplished by providing longitudinally extending frame members 143 to which a base section 144 of a basic shot blast unit is secured. Each of these frame members 143 is provided with a trunnion 145 that extends respectively to the front and rear and is journalled in a respective bearing 146 mounted on the support rail 142. This structure enables the base section 144 to be oscillated about a horizontal axis that is transversely oriented to the longitudinal axis of the unit and the axis of revolution of the carrier 15 of the cylinder heads that is positioned in the unit. Oscillatory movement of the base section 144 is effected by an oscillating drive system including an electric motor 147 mounted on the rear support rail 142 and having its output shaft mechanically coupled to the one frame member 143 as can be best seen in FIG. 15. This mechanical coupling is effected through a crank mechanism 148 which includes a crank arm 149 secured to the output shaft of the motor 147 and coupled to the frame member 143 through a connecting link 150. The link 150 is pivotally connected to both the crank arm 149 and to the frame member 143. The links of these arms are such that the base section 144 will be oscillated to about 45 degrees from the horizontal on either side of the illustrated center position. The motor 147 is provided with a gear reduction resulting in the output shaft connected to the crank arm 149 being rotated at a speed of 6 r.p.m. This results in a cyclic operation of the base section 144 each 10 seconds.

It is also advantageous during the time that the modified unit 140 is functioning in the shot cleaning phase to cause a continual flow of air into and through the unit. One objective of this airflow is to remove air entrained dust and other particles that are generated during the shot cleaning phase. A second objective is to effect cooling of the cylinder heads. This is accomplished by a provision of blowers 151 which are mounted on the cover section 152 for blowing air into the unit. The air caused to flow into the unit is exhausted through a suitable venting system 153 similar to that of the previously described shot blast unit 11, but which incorporates a flexible-type conduit 154 for interconnection with an appropriate exhaust system that preferably cleans the air (not shown). The blowers 151 may be operated for a time period of the order of ten to fifteen minutes to effectively reduce the temperature of the cylinder heads to a magnitude where they may be conveniently handled by the workers in removing them from the cage.

The carrier 15 cannot be utilized in the modified unit where there will be this oscillatory movement about an axis transverse to the longitudinal axis of the carrier without provisions for preventing the retainer frames 27 from becoming disengaged. This is accomplished by providing a support cage in the base section 144 and which will receive and retain the carrier 15. This cage 155 comprises a pair of circular end plates 156 which are interconnected in axially spaced relationship by several longitudinally extending tie rods 157 with the spacing between the end plates 156 being substantially equal to that of the carrier 15. Each end plate 156 is provided with an axially outward extending trunnion 158 that is journalled in a respective bearing 159 mounted on the end walls of the base section 144. One trunnion 158 is of a length to extend a distance outwardly of its bearing 159 and is provided with a pulley 160. This pulley 160 is coupled by a belt 161 to a drive pulley 162 that is mounted on the output shaft of an electric motor 163 having a gear reduction output section that is designed to result in revolving the cage 155 in the rage of 15–20 r.p.m. Operation of the motor 163 will thus result in revolving of the cage 155 in the interior of the base section 144. The motor 163 may be mounted as indicated on the rear frame member 143.

To permit positioning of a carrier 15 within the cage 155 and to also permit a subsequent removal, each of the end plates 156 is constructed with a hinged segmental portion **156*a* with the respective segmental portions being axially aligned. A tie rod 164 is provided to extend axially between the hinged portions 156*a* and to be removably connected therewith. Removal of the tie rod 164 enables the hinged segmental portions 156*a* to be pivoted in an outward direction about their respective hinges 165 and thereby provide access for engagement of the connector hooks 22 on the trolley and hoist unit 14 with a carrier 15. Thus the mechanical handling apparatus 13 can be utilized to lift a carrier 15 loaded with cylinder heads into and out of the cage 155 when the cage is positioned with the segmantal portions 156*a*** at the top.

Supporting the carrier 15 within the interior of the cage 155 are a pair of axially extending support rollers 166 which are similar to those previously described in conjunction with the heating unit 10. Each of the support rollers 166 is provided with the knurled surface sleeves 167 at each of the opposite ends for engagement with the peripheral edge 34 of the circular end plates 25 of the carrier 15. Retention of the carrier in a fixed position within the cage is completed by sets of holding plates 168 that are secured to each of the hinged segmental portions **156*a*. These holding plates 168 with two being provided on each segmental portion are arcuately curved plates that project axially inward of the end plates and overlie in contacting engagement with the circular end plates 25 of the carrier 15. These holding plates 168 in cooperation with the rollers 166 secure the carrier in the cage 155 with the end plates 156** of the cage holding the carrier against relative axial displacement.

It is desired that the carrier 15 not revolve within the cage 155 as the cage is revolved. This is accomplished by providing a latching mechanism 170 which functions with one of the support rollers 166. This latching mechanism is of a simple mechanical construction and comprises a latch pin 171 carried by a pivot arm 172 that is pivoted at one end to the one end plate 156 of the cage 155 by a pivot connection 173. The end of the support roller 166 is provided with an axially extending slot 174 for receiving the latch pin 171. A spring 175 which is secured to the end plate 156 and to the pivot arm 172 biases the latch pin along with its pivot arm 172 into latching engagement with the support roller. The frictional engagement of the end plate 25 of the carrier with the roller and its knurled-surface sleeves 167 thus prevents revolution of the carrier within the interior of the cage. The purpose of the latching mechanism 170 is to enable the carrier to be selectively revolved within the cage 155 if it is desired to unload the carrier while it is positioned within that cage. Operation of the pivot arm 172 to remove the latch pin 171 from the slot 174 permits the carrier to be revolved on the support rollers 166 when the cage is oriented with those rollers at a bottom position. When so positioned and with the hinged segmental portions **156*a* released from the tie rod 164 and swung outwardly about their respective hinges 165, the retainer frames 27 may then be operated as previously described to permit their removal and thus provide access to the cylinder heads and effect removal. Loading and unloading of the carrier is effected when the cage 155 is oriented with its hinged segmental portions 156*a*** uppermost, but angled forwardly to facilitate access to the carrier.

Operation of the modified airless shot blast unit 140 is substantial the same as that of the first described shot blast unit 11. During the operational phase of cleaning the cylinder heads by throwing shot against those heads, the base section 144 is not oscillated, but is maintained stationary along a horizontal plane as shown in the drawings. The oscillating mechanism is not operated during this phase of the operation although the cage 155 with its carrier 15 is revolved. For the shot cleaning function, a similar shot throwing unit 80 is operated to throw shot upwardly and against the cylinder heads contained within the carrier 15 which, in turn, is positioned within the revolving cage 155. The cage 155 is revolved at a speed of about 18 r.p.m. At the conclusion of the shot cleaning operation, the shot throwing unit is no longer operated, but the cage is continued to be revolved. Also at this point in time the oscillating mechanism is operated to cause the cyclic oscillation of the base section 144 about its transverse horizontal axis. Each oscillation cycle is of the order of 10 seconds. The combined cyclic movement of the components carried in the carrier about the longitudinal axis and an axis transverse thereto results in a highly effective shaking of the components that is deemed to be 100% effective in removal of the shot. The oscillation about the transverse axis significantly aids the revolving movement of the components as the various surfaces and cavities of the components are repetitively moved through a substantially greater range of diverse orientation than can be obtained with only the revolving of the components about one axis. The combination of cyclic movements materially increases the physical shaking effect to more effectively dislodge and enable the shot to roll out of the various cavities. In those cases where the components are not rigidly fixed in the carrier 15, there will be the added benefit of mechanical shock forces applied to the components with these forces tending to vibrate or jar loose the shot which may be retained in the cavities. During the shot removal phase of operation, the blowers 151 may be continued in operation to maintain a flow of air through the unit for not only continued elimination of dust and other air entrained debris particles, but to also continue cooling of the components. This continued cooling is of particular advantage where the components are to be unloaded from the carrier at the conclusion of this step of the cleaning operation.

Figure 17:
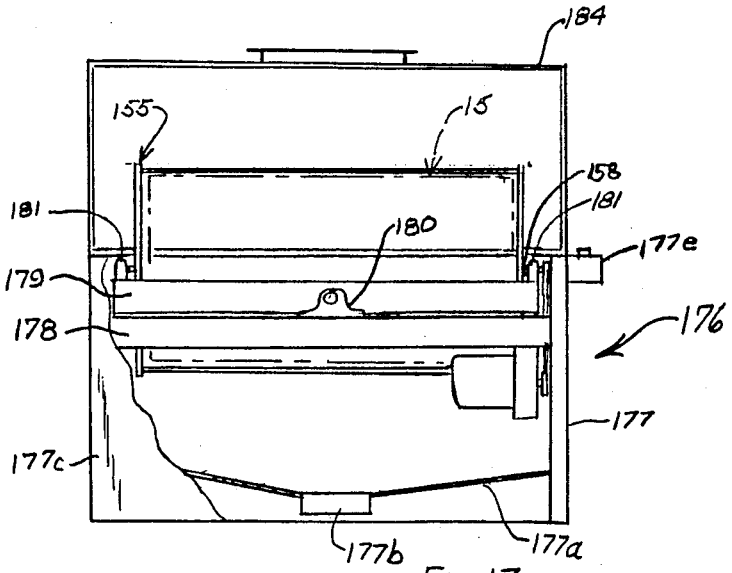
FIG. 17 is a front elevational view of a shaker unit with portions thereof broken away for clarity of illustration.
Figure 18:
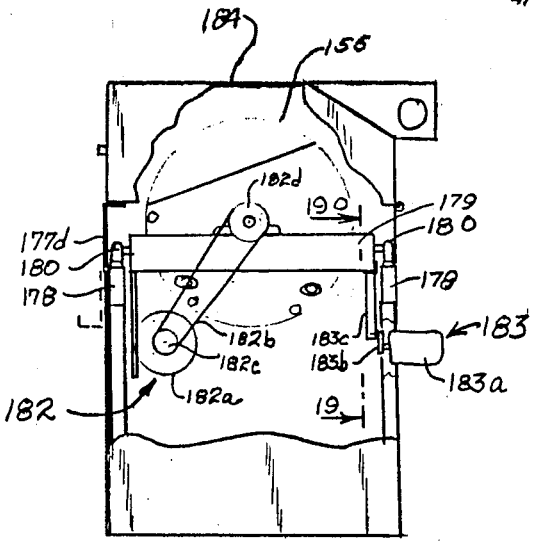
FIG. 18 is an elevational view of the shaker unit shown in FIG. 17, but also having portions thereof broken away for clarity of illustration.
Figure 19:
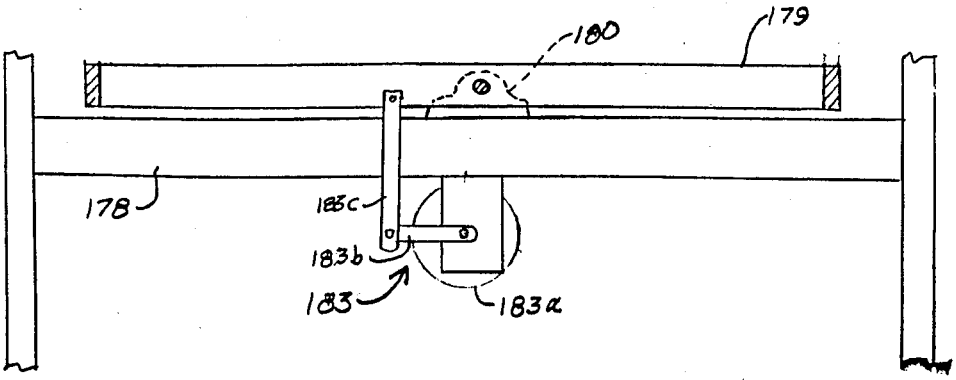
FIG. 19 is a fragmentary sectional view taken along line 19—19 of FIG. 18.
Figure 21:
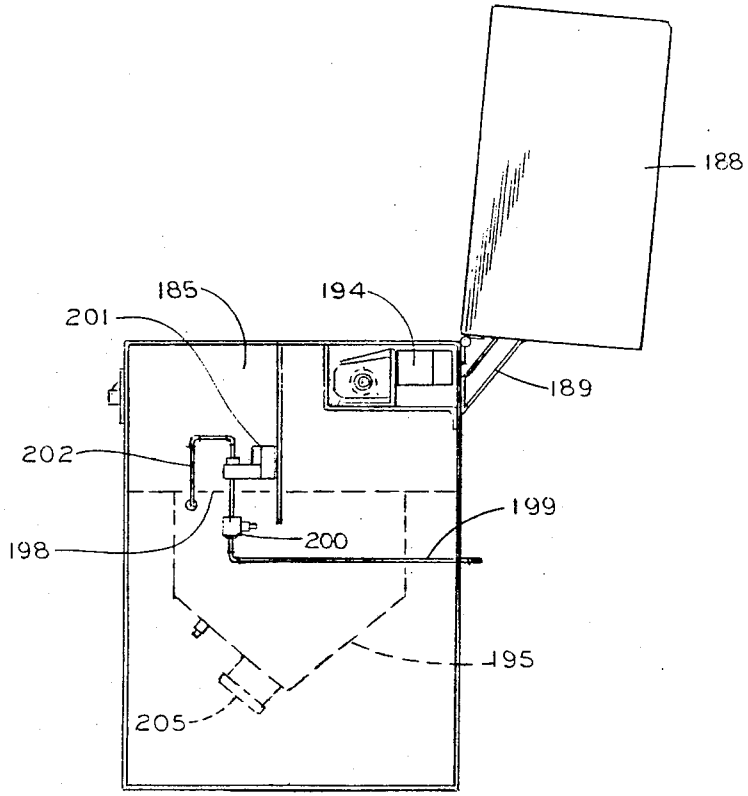
FIG. 21 is an elevational view of the right end of the bath unit.
Figure 20:
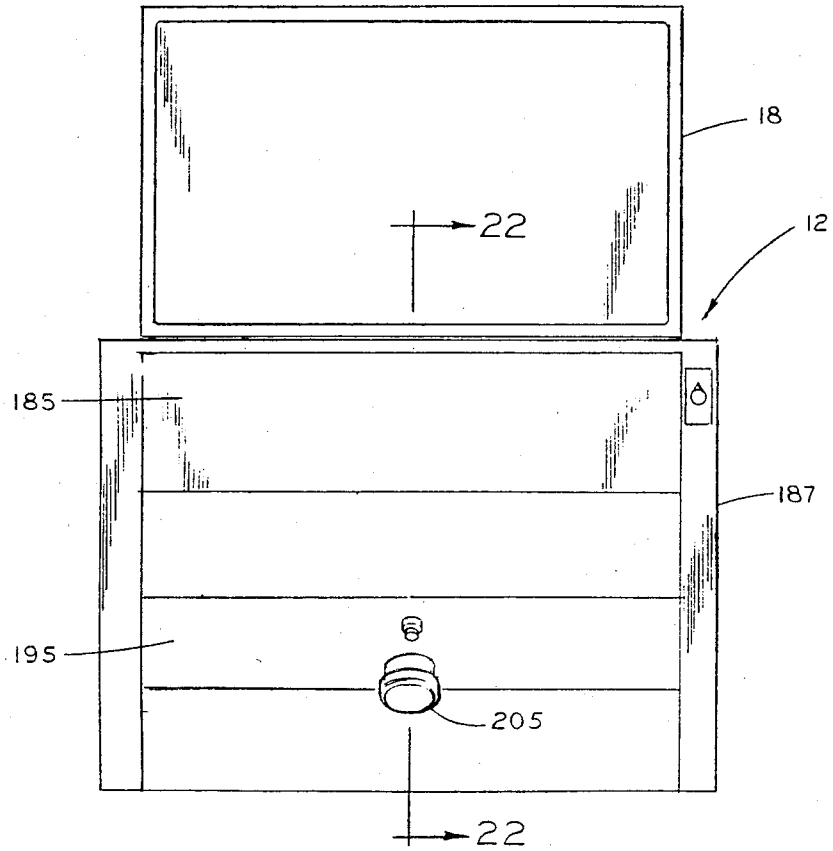
FIG. 20 is a front elevational view of an agitated liquid bath unit.
Figure 22:
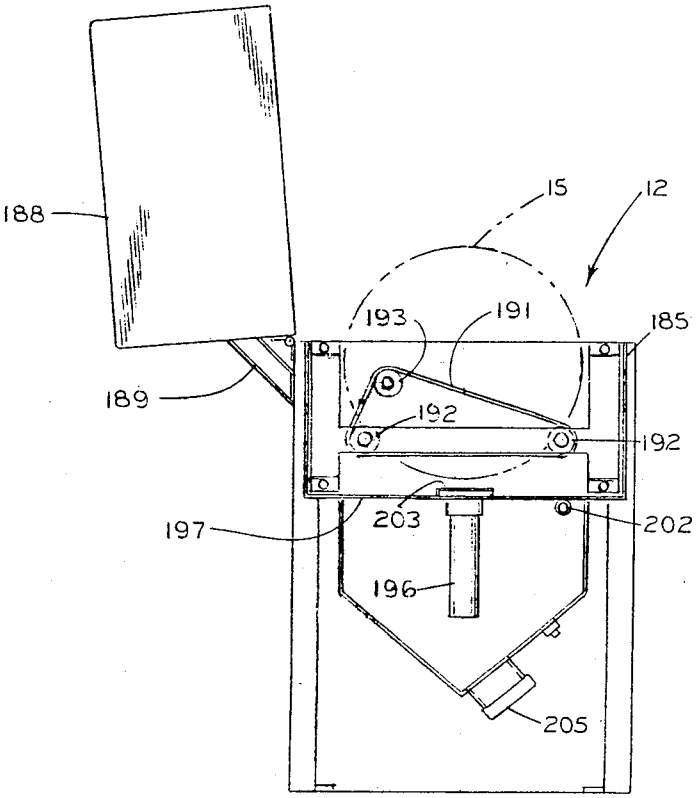
FIG. 22 is a sectional view of the bath unit taken along line 22—22 of FIG. 2O.

Although the modified airless shot blast unit 140 is advantageous in that it provides for a combination of the shot cleaning operation as well as a subsequent physical shaking operation for removal of the shot in a single unit, it may be desired to have the shot cleaning operation performed by a separate unit such as unit 11 previously described and an additional unit designated a shaker unit 176 having the sole function of providing the shaking operation such as that which is provided in the combined apparatus unit shown in FIGS. 13–16. A shaker unit 176 for this sole function is shown in FIGS. 17, 18 and 19 of the drawings. This shaker unit includes a base section 177 incorporating a structural frame that includes two longitudinally extending frame members 178 and wall panels enclosing and providing protection as to the moving components. Supported on the frame members 178 is a rectangularly shaped oscillating frame 179. Trunnions on the longitudinal portions of the oscillating frame 179 are journalled in respective bearings 180 secured to the frame members 178, thereby enabling the oscillating frame to oscillate in a vertical plane about an axis transverse to the longitudinal axis of the unit. Supported on the oscillating frame 179 is a cage 155 embodying the same structure previously and designed to receive and retain a carrier 15 therein for revolution of the cylinder heads about a longitudinal axis of the unit. The cage 155 is supported on the oscillating frame 179 by trunnions journalled in respective bearings 181 mounted on the end members of the oscillating frame. Revolution of the cage 155 is effected by a drive system 182 that includes an electric motor **182*a* coupled in driving relationship with the cage by a belt 182*b* trained around a pulley 182*c* mounted on the motor output shaft and a pulley 182*d* mounted on the one supporting trunnion 158 of the cage. Oscillation of the frame 179 is effected by an oscillating drive system 183 similar to that which was described with respect to the modified shot blast unit 140. This oscillating drive system includes an electric motor 183*a* mounted on the one frame member 78 of the base section structural frame and coupled to a longitudinal member of the oscillating frame 179 by a crank mechanism. This crank mechanism includes a crank arm 183*b* mounted on the output shaft of the electric motor 183*a* and coupled with the oscillating frame by a connecting link 138*c*. The dimensions and attachment of the crank mechanism is such that the oscillating frame 179** will be oscillated through an arc of about 45 degrees to either side of the illustrated horizontal position.

A cover section 184 is also provided for the shaker unit 176 and is pivoted to the base section 177. This cover section 184 is similar to that described with the modified unit 140 and includes blowers 151 for blowing air into the unit and exhausting the air through a similar venting system 153 for dust removal and continued cooling. However, with the shaker unit 176 the connection of the venting system to an air cleaner does not require any flexible type interconnection. Since shot is removed in this unit in the same manner as that of the modified unit 140, means are provided for collection of the shot in the shaker unit whereas the modified unit 140 merely returns the collected and removed shot to the shot throwing unit. This shot collecting means in the skaker unit 176 includes a bottom wall **177*a* that inclines downwardly from each end of the base section to the center and a shot collecting drawer 177*b* positioned between the two sloped bottom wall sections. The shot collecting drawer 177*b* can be removed from the front of the unit so that shot collected by falling onto the bottom wall and rolling into the drawer can be returned to the shot throwing unit of the shot cleaning unit 11**.

The shaker unit 176 as previously indicated operates in a manner similar to that of the modified unit 140 for producing the combined tilting and rotational movements for effecting the removal of shot from the cylinder heads that are being cleaned. Also, the shaker unit 176 provides for cooling of the cylinder heads so that if no further cleaning operations are to be effected, the heads may then be removed from the carrier contained within the cage 155 at the completion of the shaking operation. Removal is facilitated by forming the front wall panel **177*c* of the base section with a hinged door section 177*d* that may be swung downwardly to the broken line position shown in FIG. 18. Although not specifically described or illustrated, suitable electrical controls are provided for controlling the operation of the blowers and the drive systems and which may be housed in a control box 177*e* mounted on one side of the base section. Again, these controls are of a well-known type and incorporate commercially available structures with which the skilled artisan is familiar and can be readily incorporated in the unit. Utilization of a shaker unit 176 in combination with a basic shot blast unit 11 provides further advantage in total processing time. Separation of the functions such that shot removal and cooling is carried out by a shaker unit 176** results in a saving of time since the shot blast unit may then be used substantially continuously for the shot blast operation without the otherwise lost time for the shot removal operation.

While the modified airless shot blast unit 140 and the shaker unit 176 are highly effective in removing shot from the cylinder heads at the conclusion of the shot blast operation, it may be desired to also subject the cylinder heads to a further cleaning procedure as is desired with the basic shot blast unit 11 if it is not used with a shaker unit 176. In accordance with this invention, the further cleaning procedure involves an agitated liquid bath which is effected by the unit 12 illustrated in FIGS. 20–23. This agitated liquid bath unit 12 comprises a liquid tank 185 that is mounted on a structural frame 186 and substantially enclosed within a housing. Controls for the operation of the unit are mounted on an end panel 187 of this housing. A cover 188 is also provided to close over the top of the liquid tank 185 and is hinged at the rear of the housing. This cover 188 also may be provided with a suitable counterweight 189 to facilitate its opening and closing. A carrier 15 loaded with cylinder heads is adapted to be positioned within the liquid tank 185 and to be revolved therein during the operation of the unit to effect cleaning and conditioning of the cylinder heads. Support of the carrier 15 is accomplished by a pair of support rollers 190 which extend longitudinally through the tank at a position to maintain the major portion of the carrier within the confines of the tank. These support rollers 190 are similar to those previously described in conjunction with the heating unit and have knurled sleeves **190*a* which engage with the peripheral edges of the circular end plates 25 of the carrier. A drive belt 191 is trained around pulleys 192 secured to the rollers and also a pulley 193 that is mounted on the output shaft of an electric motor drive unit 194. This drive unit 194 is mounted at the uppermost portion of the tank and its shaft extends into the interior of the tank through a suitable fluid seal although the maximum operating level of the fluid in the tank is not expected to be above the shaft of the motor 194 on which the pulley 193** is mounted.

Figure 23:
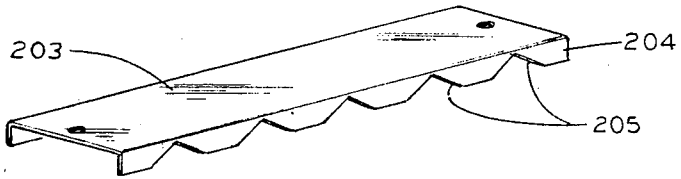
FIG. 23 is a perspective view on an enlarged scale of the liquid inlet distributor plate of the bath unit.

In the operation of the agitated liquid bath unit 12 the liquid tank 185 is empty when the carrier 15 is first positioned within the tank. The liquid is then introduced concurrently while the carrier is being revolved. Accordingly, a reservoir 195 is provided for containing the liquid that is to be introduced into the tank. This reservoir 195 is carried on the frame structure immediately below the liquid tank and is of a size to contain a sufficient quantity of the liquid to fill the tank to a desired level. Filling of the tank from the reservoir 195 is effected by an air pressure charging system. A standpipe 196 communicating with an opening in the bottom wall 197 of the tank extends a predetermined distance downwardly into the interior of the reservoir 195. A pressurized air system 198 is provided for introducing air into the reservoir at its top. This air system 198 includes a conduit 199 for connecting with a suitable source of pressurized air. Control valves 200 and 201 are provided in the conduit with the outlet from the second control valve 201 leading into the reservoir. With the reservoir filled with an appropriate quantity of the liquid, the control valves are operated to admit pressurized air into the reservoir and thereby pressurizing the reservoir. As air is admitted into the reservoir, the result is that liquid will be forced upwardly through the standpipe 196 and into the liquid tank 185. To enhance the agitation of the liquid as will be further described, a distributor plate 203 is secured to the bottom wall 197 of the tank. This distributor plate, as can be best seen in FIG. 23, is formed as an inverted elongated channel having relatively short longitudinal side flanges 204 that are each formed with a series of spaced apart notches 205 of inverted V-shape. The liquid as it is forced up through the standpipe 196 will thus flow longitudinally of the distributor plate 203 to exit at its opposite ends as well as flowing outwardly in a lateral direction through the notches 205. Liquid is caused to be continued to flow into the tank until such time as the level of the liquid in the reservoir 195 recedes to the bottom of the standpipe 196. At this point, continued addition of pressurized air into the reservoir will result in air then flowing up the standpipe and being spread laterally by means of the distributor plate 203. The effect of the air flowing up the standpipe and out through the distributor plate is to produce a uniform agitation of the liquid throughout the tank 185. This effect of the agitation is highly effective in further cleaning of the cylinder heads and removal of any possible remaining shot. The agitated liquid bath also performs the function of further cooling the components.

The particular fluid that is utilized in the agitated liquid bath unit 12 is a mixture of water and a commercially available water soluble chemical emulsion that not only aids in the removal of shot, but also performs the function of conditioning the cylinder heads by providing them with a coating for inhibiting formation of rust. The particular chemical emulsion that has been found highly desirable in the practice of this invention is that which is availab1e from Cincinnati Milacron Marketing Company located in Cincinnati, Ohio. The particular emulsion is marketed by this company under the trade name CIMCOOL FIVE STAR 40 and is mixed with water in the proportions of one quart of the emulsion with fifteen gallons of water. Mixing the emulsion in a higher ratio is not desirable as the mixture then tends to gel and cannot be properly agitated by the air agitation system.

Upon completion of the liquid cleaning operation which, in most cases, continues for a time period of about ten minutes, the system is operated to then permit removal of the liquid from the tank 185. This is accomplished by operating of the control valve 201 to enable exhausting of the air from the reservoir at a predetermined flow rate. As the liquid returns to the reservoir 195 through the standpipe 196, the carrier 15 is continued to be revolved. This procedure has been found highly effective in assuring that any shot or other debris contained within the cylinder heads will be effectively removed. As the carrier 15 is revolved in conjunction with the lowering of the liquid level, the continued changing of the orientation of the heads will assure that any shot contained within the head cavities will roll out and drop to the bottom of the liquid tank. It is important that the carrier 15 be continued to be revolved as the liquid flows out of the tank 185. Shot or other debris that should accumulate within the liquid tank may be cleaned from the tank when it is empty and any such debris which enters into the reservoir can be cleaned at periodic intervals from that tank through a suitable clean out 205.

Figure 24:
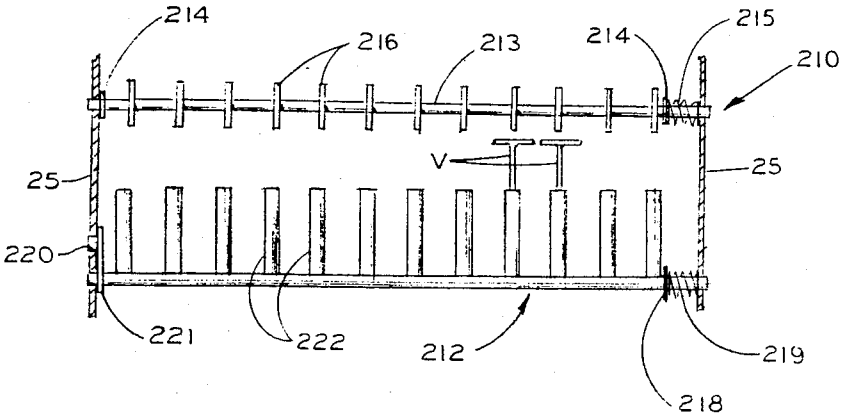
FIG. 24 is a plan view of the components for holding of valves in the carrier.

While the foregoing description of the apparatus, particularly the carrier 15 and its operation has been illustrative of its use in conjunction with cylinder heads, it will be noted that the carrier can also be readily adopted for cleaning of the valve for such engines. The carrier 15 may be provided with a valve holding apparatus 210 such as that which is illustrated in FIG. 24 and which can also be seen in FIG. 2A. This apparatus includes a valve head support 211 and a valve stem receiver 212. The valve head support 211 includes an elongated shaft 213 which is provided with stop flanges 214 at each end. These stop flanges 214 are spaced inwardly of the extreme end of the shaft 213 to permit one end to be inserted in a socket in one end plate 25 of the carrier and the other end to receive a compression spring 215 and to also enter into a respective socket of the opposite end plate 25 in a manner similar to that of the retainer frames 27. Positioned in spaced relationship along the shaft are a number of circular discs 216. The valve stem receiver 212 includes an elongated shaft 217 which is also provided with stop flanges 218 and a compression spring 219 to permit mounting between the opposed end plates 25 of the carrier in a manner similar to that of the valve head support 211. The one stop flange 218 includes a second stub shaft 220 that is secured in radially outward relationship to the shaft 217 by a fixed arm 221 and is adapted to enter into another aperture or socket formed in the respective end plate. The function of this stub shaft is to fix the valve tem receiver shaft 217 against rotation with respect to the end plates. Secured to the shaft 217 are a number of tubes 222 which are adapted to receive the stems of engine valves with a few of these valves V shown in FIG. 24. These tubes 222 are of a length to receive a major portion of the valve stem which does not normally require any severe cleaning procedure as do the valve heads and are spaced along the shaft to be aligned with respective ones of the circular discs 216 positioned on the valve head support shaft 213. The valve holding apparatus 210 is positioned in the carrier with the valve head support 211 disposed at the center of the carrier. This enables a plurality of valve stem receivers 212 to be positioned in the carrier and hold a large number of valves. The valves are positioned with their stems inserted into the respective tubes 221 where they will be protected from being shot blasted during the cleaning operation. The valve stem receiver 212 is positioned with respect to the valve head support 211 such that the heads of the valves may contact with the respective discs 216 and thereby result in retaining of the valves in the apparatus. The valve heads are exposed and are subjected to the cleaning operations.

The trolley and hoist unit 14 was briefly described in conjunction with the preliminary description of the mechanical handling apparatus 13. Further details of the structure of the illustrative trolley and hoist unit 14 are best seen in FIGS. 25 and 26. The unit includes a trolley frame 225 which is of a U-shaped construction having vertical sidewalls 226 which extend on opposite sides of the horizontal rail 16. A pair of trolley rollers 227 are journalled at opposite end.sof the frame 225 at the upper portion thereof and between the sidewalls 226. These rollers 227 are adapted to engage with the upper surface of the rail 16 and permit movement of the unit along that rail. A pair of stabilizing rollers 228 are also provided and are mounted on respective ones of the sidewalls 226 at a position to engage with a lower sidewall portion of the rail 16. A protective shield 229 is provided at the forwardly facing side for safety purposes. It is secured to the top of the frame 25 and extends a distance downwardly sufficient to cover the operating components of the unit. The hoist mechanism 230 includes a cable shaft 231 journalled on a bracket **231*a* mounted on the bottom of the trolley frame 225 and onto which the hoist cable 21 is wound. In this illustrative embodiment, the hoist cable is a single endless cable having two end portions which extend downwardly in spaced relationship. The cable itself is secured to the shaft 231 by a friction mechanism that permits adjustment of the cable to obtain equalization as to the position of the terminal ends of the cable and the connector hooks 22. This friction mechanism comprises a pair of circular flanges 232 that are fixed onto the shaft 231 in axially spaced relationship. Each of the flanges 232 has an aperture extending axially therethrough and through which the cable 21 extends. With the cable unwound from the shaft, the cable may be displaced through those apertures on the flanges 232 to a position where the cable ends will be equidistant from the shaft. Driving of the shaft 231 is effected by an electric motor unit 233 which includes a breaking mechanism 234. A motor controller 235 is also provided and is suspended by its control cable 236** from the motor unit.

From the foregoing description of the several apparatus units and their respective functions, it will be apparent that these units may be utilized in several different combinations to accomplish the basic objectives of this invention. These basic objectives have the cumulative objective of effective cleaning various internal combustion engine components with a high degree of efficiency and include (1) utilization of airless shot blasting for removing of debris and to the advantage of that techniques efficiency and effectivity in performance of cleaning functions;

(2) effect a 100 percent removal of the shot from the components utilizing apparatus designed to repetitively move the components in cyclic patterns that result in the components being continually differently oriented in space, thereby enabling the shot to roll out of cavities as a consequence of what is in effect a physical shaking of the component;

(3) heating of the components as a first step in the cleaning procedure to burn off combustible debris and heating of the components to an elevated temperature where the debris and scale is more easily removed by shot blasting;

(4) transferring the heated components at the elevated temperature to the shot blast operation for processing by mechanical handling apparatus permitting handling of a plurality of components with concurrent processing at each stage for minimizing labor costs and total processing time; and (5) subjecting the components to an agitated liquid bath in which the liquid is a mixture of water and a chemical emulsion that functions as a lubricant to aid in removal of shot and to form a rust inhibiting coating on the components.

The several apparatus units of this invention may be utilized in several different combinations to process the engine components by the method of sequentially (1) heating the components to an elevated temperature to burn off combustible debris or leave the debris adhered to the surfaces in a dry state;

(2) subjecting the components to a shot blast cleaning operation; and (3) removing the shot from the components by a physical shaking action.

There are alternative combinations of disclosed apparatus for performance of the second and third steps and, additionally, the procedural step of subjecting the components to an agitated liquid bath may be included as a last step in the cleaning procedure. Utilization of either the shot blast unit that incorporates the multi-axis shaking or the separate shot blast and shaker units need not be used with a following agitated liquid bath unit unless the maximum assurance of effectivity in removing shot is desired or that it is desired to apply a rust inhibitor to the components.

It will be readily apparent that the apparatus and method provided by this invention for the cleaning of components of internal combustion engines results in a very efficient and highly effective technique for cleaning of such item. Providing of the apparatus for assuring complete removal of the shot from the numerous and complex configured cavities formed in many of these components has enabled use of the efficient and effective shot blast cleaning with these engine components. This effective removal of shot by multi-axis cyclic shaking of the components provides the necessary reliability that has resulted in acceptance of the shot cleaning technique for engine components.

Having thus described the invention, What is claimed is:

1. Apparatus for cleaning of metallic articles comprising a heating unit having a heating chamber adapted for receiving therein at least one article and including article support means for supporting of the article and revolving the article about a substantially horizontal axis and fuel combustion means for producing flame heat in a region underlying the space in which the article is revolved, whereby combustible debris carried on the article will be burned and the article heated to a predetermined elevated temperature, debris removing means for operating on the article after it has been processed in said heating unit to remove debris adhered to surfaces of the article, said debris removing means including a chamber adapted for receiving the article therein, shot blast means for directing shot along a predetermined path against surfaces of the article with force sufficient to dislodge debris adhered thereto and respective article support means included in said debris removing means for supporting the article in the path of the shot to cause all surfaces of the article to be contacted by the shot and to physically manipulate the article to to blasting it with shot so as to shake shot out of any cavities formed in the article.

2. Apparatus according to claim 1 which includes a carrier adapted to receive at least one article therein in retained relationship and to cooperatively interfit with the article support means in each of said heating unit and said debris removing means to be revolved about at least a substantially horizontal axis.

3. Apparatus accoring to claim 2 wherein said carrier includes a pair of end walls rigidly secured together in axially spaced relationship with each end wall having a circular peripheral edge and the respective article support means of each of said heating unit and said debris removing means including pairs of support rollers disposed in laterally spaced apart relationship and adapted to engage with the peripheral edge of the respective carrier end walls in supporting of the carrier thereon.

4. Apparatus according to claim 3 wherein the respective article support means of each of said heating unit and said debris removing means includes drive means drivingly coupled with at least one roller of each pair and selectively rotatable to revolve the carrier supported thereon.

5. Apparatus according to claim 2 wherein said carrier includes a plurality of article retaining means releasably engageable with at least one article.

6. Apparatus according to claim 2 which includes carrier transport means detachably engageable with a carrier and selectively operable to vertically displace a carrier relative to the respective support means of each of the heating unit and debris removing means and to move the carrier from one to the other.

7. Apparatus according to claim 6 wherein said carrier transport means includes a trolley rail supported a distance vertically above and overlying each of the said heating unit and debris removing means and a trolley mounted hoist unit mounted on said trolley rail for displacement therealong, said trolley hoist unit including connector means detachably engageable with a carrier and selectively operable to vertically displace a carrier.

8. Apparatus according to claim 1 wherein said article support means of said debris removing means is selectively operable to revolve the article about a first axis which is substantially horizontally disposed while the article is being blasted with shot.

9. Apparatus according to claim 1 wherein said article support means of said debris removing means is selectively operable subsequent to blasting of the article with shot to concurrently revolve the article about a first axis and to oscillate the article about a second axis disposed substantially horizontal and transversely to the first axis.

10. Apparatus according to claim 9 wherein said article support means oscillates the article through an arc of the order of 90 degrees centered on a substantially horizontal plane.

11. Apparatus according to claim 1 which includes second debris removing means for operating on the article in sequence following the said first mentioned debris removing means, said second debris removing means including a tank for containing a liquid of predetermined depth, said liquid being a mixture of water and CIMCOOL FIVE STAR 40 chemical emulsion in the ratio of one quart of emulsion to 15 gallons of water, article support means for supporting the article for revolution about a substantially horizontal axis through a path whereby the article will be immersed in the liquid during a portion only of its path of revolution, liquid agitation means for agitating the liquid, and means for relatively removing the article from the liquid while the article is being revolved.

12. Apparatus according to claim 11 wherein said means for removing the article from the liquid includes liquid transfer means selectively operable to drain the liquid from the tank.

13. Apparatus according to claim 11 wherein said liquid agitation means includes air supply means for introducing a flow of air into the liquid at a point below the lowest portion of the path of revolution of the article and air distributor means for distributing the air throughout a predetermined region of sufficient size to result in the article being immersed in a region of agitated liquid.

14. Apparatus according to claim 1 wherein said debris removing means includes a shot blast unit and a shaker unit, said shot blast unit including a chamber for receiving an article therein and having article support means for support of an article in the chamber for revolution about a substantially horizontal axis and shot blast means for directing shot along a predetermined path against surfaces of the article, said shaker unit including a support frame, an oscillating frame mounted on said support frame for oscillation about a substantially horizontal axis and article support means mounted on said oscillating frame for revolving an article about an axis disposed transversely to the oscillation axis, said axis of revolution oscillated through an arc of the order of 90 degrees centered with respect to a substantially horizontal plane.

15. Apparatus according to claim 14 wherein the article support means of said shaker unit includes a cage mounted for revolution on said oscillating frame and an article carrier adapted to receive at least one article therein in retained relationship, said article carrier adapted to cooperatively interfit with the respective article support means of each of said heating unit, shot blast unit and the cage of said shaker unit, said cage engageable with the carrier to retain the carrier in fixed relationship and selctively disengageable therefrom to permit revolution of the carrier within said cage.

* * * * *